United States Patent [19]

Cirrito

[11] Patent Number: 4,609,328

[45] Date of Patent: Sep. 2, 1986

[54] METHOD AND APPARATUS FOR TOTAL ENERGY SYSTEMS

[75] Inventor: Anthony J. Cirrito, Grafton, Mass.

[73] Assignee: CTP Partners

[21] Appl. No.: 555,180

[22] Filed: Nov. 25, 1983

Related U.S. Application Data

[62] Division of Ser. No. 160,819, Jun. 18, 1980, Pat. No. 4,430,046.

[51] Int. Cl.[4] ..... F04F 5/00

[52] U.S. Cl. ..... 417/55; 417/89; 417/158

[58] Field of Search ..... 417/151, 198, 196, 89, 417/187, 158, 159, 179, 180, 182, 194, 53, 54

[56] References Cited

U.S. PATENT DOCUMENTS

| | | | |
|---|---|---|---|
| 1,267,897 | 5/1918 | Pagel | 417/89 X |
| 2,020,180 | 11/1935 | Havill | 417/89 X |
| 2,172,522 | 9/1939 | Sline | 417/198 X |
| 2,444,615 | 7/1948 | Reinhardt | 417/197 X |
| 2,524,559 | 10/1950 | Campbell et al. | 417/198 X |
| 3,254,483 | 6/1966 | Martin et al. | 417/159 X |
| 3,589,383 | 6/1971 | Garnier | 417/159 |

FOREIGN PATENT DOCUMENTS

| | | | |
|---|---|---|---|
| 652749 | 5/1951 | United Kingdom | 417/89 |

OTHER PUBLICATIONS

Author: George Rudinger, title: Effect of Velocity Slip on the Burning Rate of Fuel Particles, Bell Aeorspace Div. of Textron, Buffalo, NY, date: May 13/15, 1974, pp. 35–39, Joint Fluids Engr. & CSME Conference, Montreal, Quebec.

Author: A. J. Simpkin and K. Berman, Title: Bell High Mass Flux Gasifier, Bell Aerospace Textron, P.O. Box One, Buffalo, NY 14240, presented at: The Tenth Synthetic Pipeline Gas Symposium, DesPlains Ill., Oct. 30–Nov. 1, 1978, work performed under U.S. Dept. of Energy Contract No. EX-76-C-01-2204.

Author: C. L. Oberg; L. P. Combs; J. Friedman, Title: Rocket Reactor Technology Applied to Coal Conversion, Rockwell Int'l., pp. 407–437, date: May 14–18, 1979.

*Primary Examiner*—Edward K. Look

*Attorney, Agent, or Firm*—Charles E. Pfund

[57] ABSTRACT

Combustion jet pumps ingest waste heat gases from power plant engines and boilers to boost their pressure for the ultimate low temperature utilization of the captured heat for heating homes, full-year hot houses, sterilization purposes, recreational hot water, absorption refrigeration and the like. Jet pump energy is sustained from the incineration of solids, liquids and gases and vapors or simply from burning fuels. This is the energy needed to transport the reaction products to the point of heat utilization and to optimize the heat transfer to that point. Sequent jet pumps raise and preserve energy levels. Crypto-steady and special jet pumps increase pumping efficiency. The distribution conduit accepts fluidized solids, liquids, gases and vapors in multiphase flow. Temperature modulation and flow augmentation takes place by water injection. Macro solids such as dried sewage waste are removed by cyclone separation. Micro particles remain entrained and pass out with water condensate jet beyond each point of final heat utilization to recharge the water table. The non-condensible gases separated at this point are treated for pollution control. Further, jet pump reactions are controlled to yield fuel gas as necessary to power jet pumps or other use. In all these effects introduced sequentially, the available energy necessary to provide the flow energy, for the continuously distributed heating medium, is first extracted from fuel and fuel-like additions to the stream. As all energy, any way, finally converts to heat, which in this case is retained or recaptured in the flow, the captured heat is practically 90% available at the point of low temperature utilization. The jet pump for coal gasification is also disclosed as are examples of coal gasification and hydrogen production.

34 Claims, 12 Drawing Figures

METHOD AND APPARATUS FOR TOTAL ENERGY SYSTEMS

This is a division of application Ser. No. 160,819 filed June 18, 1980, now U.S. Pat. No. 4,430,046.

METHOD AND APPARATUS FOR TOTAL ENERGY SYSTEMS

This invention relates to the conservation of available energy. Available energy includes specific heat and the power delivered at the shaft of an internal combustion engine and, in stream flow, it includes kinetic and flow (Pv) Energy where 'v' stands for the specific volume of the gas or gas mixture at static pressure, P. The total available energy is extracted from fuel fired in an engine cycle by ultimately using the heat and kinetic and flow energy for heating as in residential heating and other non-mechanical energy sinks.

In one application of this invention, energy is applied to pump waste heat gases from power plant engines and boilers to points of low temperature heat utilization such as homes, full-year hot houses, recreational hot water and the like.

Accordingly, this invention first establishes a conduit for distributing the hot gases from a combination primary source and other heating media in fluidized form. At the outset the conduit is maintained at high temperature by incinerating fluidized solids and additionally burning regular fuel as needed. Further down stream, secondary fuels such as sewage sludge, may be pumped in at system pressure. The sludge may be either dried or burned depending on the local need. Dried sludge is cyclone separated and discharged through a lock hopper to preserve system pressure. Water converts to steam and mixes downstream with other gases.

Fuel gasification stations are also provided in branch lines set aside for this purpose. Coal slurry is introduced as secondary flow to a combustion jet pump and main line fluid is metered in as necessary to complete the gasification reactions. This gas becomes the fuel supply for the power plant, and booster pumps along the conduit.

The conduit and its tributaries accommodate multiphase flow. The pressure of the system is maintained by booster pumps along the way. Novel combustion-jet pumps are disclosed and are useful for this purpose for the following reasons:

1. They can be designed for abraison resistance and for very high temperatures (up to stoichiometric temperatures).

2. Their geometry conveniently blends flows and captures and transfers heat.

3. Fuel may be fired in the high pressure zone discharging the primary jet and/or in the mixing zone where fuel may also be fed. When both zones are fired, the pump becomes a compression-combustion-expansion-combustion-expansion engine which develops thrust for pumping.

4. They conveniently adapt to fuel gasification which, as disclosed, provide novel sub-combinations of the invention.

Crypto-steady and other special jet pumps which also embody the above advantages are used when higher pumping efficiencies are required.

In the final down-stream branches which deliver the ultimate low temperature heat, flow velocities and pressures are maintained sufficiently high and temperatures are modulated by water injection in order to optimize the heat transfer rates to heat storage facilities located at each home and other end-use locations.

It is this end-point balance with kinetic and flow energy on one side and optimal heat transfer on the other that avails practically 100% of the heat at points of low temperature heat utilization. However, this balance is also the most efficient way to transfer heat at higher temperature levels. Accordingly, the conduit source of heat may be trapped at any level, and the level may even be boosted locally by combustion jet-pumps for local industrial and commercial needs for power and/or heat.

Returning now to the low temperature end-use point, the fluid delivers its heat to the heat storage facility at the optimal heat transfer rate above described. Recirculating hot water and hot air heating systems at the homes draw from this facility by thermostatic controls as they would from a conventional furnace. Absorption refrigeration systems for air conditioning also draw from this facility.

The heating medium is ducted from the storage facility to a gas separator, where the gas is processed for pollution control and the condensate with entrained minute particles is treated if necessary or used for irrigation or it simply recharges the water table.

In prevailing heat transfer systems non-condensible gases are considered deleterious and operate to increase the resistance to heat transfer. It is therefore important by this invention to maintain the non-condensible gases and super heated steam in the mixture moving at appreciable velocities over the heat transfer surfaces. This is the effect produced by maintaining enough kinetic and flow energy in the balance earlier described.

The overall system of this invention applies to any total energy requirement large or small:

A large community

An apartment house

A residential development

A large power plant and surrounding neighborhood

The invention pursuant to the foregoing discussion embodies the following objectives:

1. To conserve the available energy potential of fuels statistically available.

2. To raise the pressure of a waste fluid by a fluid-power source to boost its available energy potential, in a mixed flow with the fluid of the energy source, to the extent necessary for transporting the mixed flow as a heating medium to a point of low temperature heat utilization and to effect a substantial heat transfer rate at that point.

3. To distribute and utilize the waste gases from stationary engines and boilers in power plants.

4. To establish a main insulated conduit with tributaries for transporting a heating fluid composed of fluidized solids, liquids, gases and vapors to points of low temperature heat utilization.

5. To maintain and/or raise the pressure level in the main conduit by sequent sources of fluid power whereby the fluids from said sources become entrained in the heating medium.

6. To introduce combustion-jet pumps for maintaining and/or raising the pressure level in the main conduit and to raise the temperature levels when necessary to incinerate pollutants which may be pumped in as liquid or water-logged solids or ingested with air when they are relatively dry solids.

7. To employ crypto-steady pressure exchange jet pumps when higher pumping efficiencies are required.

8. To transform liquids into gases and vapors by direct heat and mass transfer.

9. To separate useful dry solids through inertial methods.

10. To gasify fuel in selected tributaries of the main conduit for use at the power plant and for other external uses.

11. To process pollutants to a more useful fuel state for external uses as in item 10 or for redirection to power a jet pump at some other point in the system.

12. To pump in water in order to augment flow and to lower and modulate the temperature of the heating medium.

13. To couple a high temperature jet pump to a high pressure high temperature chamber whereby a. the chamber may be pressurized by any compressed fluid such as steam or combustible mixtures;

b. the secondary ports may be arranged to feed in oxidants and/or any combustible fluid or fluids;

c. the temperatures of the fluid in the primary jet is above the ignition temperature of the combustibles which enter through secondary ports;

d. excess oxygen is fed at the secondary ports to complete the combustion reaction which took place in the high pressure chamber;

e. to effect combustion in the high pressure chamber at temperatures up to stoichiometric levels.

14. The jet pumps of item 13 are characterized as combustion-jet pumps. In addition to maintaining or raising the pressure in the main conduit, etc., as covered in item 6, they also function to gasify fuel, principally fossil fuel. Liquid fuel will be intrained in droplets and solids, principally coal, as particles. The term particle will be used as applying generally to both. However, the gasification of coal is the preferred embodiment and the combustion-jet pump is used in the following ways at least in coal gasification:

a. The main objective is to operate the primary jet at near-sonic velocities and to introduce the coal particles preferably in a water slurry at negligible velocities. In this way the large slip velocities accompanying the acceleration of particles effect extremely high heat and mass transfer rates.

b. Generally much of the heat for the reaction is supplied by the combustion products of the primary jet operating with stagnation temperatures up to stoichiometric levels.

c. These temperatures are reduced in most modes by injected water which becomes steam to enter in the water-gas reaction starting in the jet pump.

d. More oxidant is added in the secondary ports with slurry to satisfy the endothermic requirement.

e. Alternately, the balance is achieved by operating the primary jet oxidant rich.

f. Items a through e apply to the production of:
low and medium BTU Gas
Synthesis gas ($CO+H_2$)

g. To obtain devolatilized gas products, the objective is to develop relatively inert products of combustion in the primary near-sonic jet, while introducing coal particles in the secondary ports at negligible velocities.

h. The jet pump can also be used to effect the shift reaction whereby $$(CO+H_2)+H_2O_{(g)}—CO_2+2H_2$$

Steam is introduced in the secondary ports of a sequent jet pump just down stream from the jet pump producing $$(CO+H_2)$$

Other objects of the present invention together with the above objects, may be more readily understood by considering the detailed description which follows, together with the accompanying drawings in which:

FIG. 3A is a diagram showing relations in the hydrogen production process.

THE PRODUCTION OF HOT HIGH PRESSURE GASES FOR HEAT UTILIZATION

As mentioned above, in accordance with the invention, high pressure high temperature gases are created by coupling high pressure combustion chambers to high temperature jet pumps for capturing waste heat gases and pollutants in multiphase flow and processing them in captured flow for heat utilization. The jet pump means for creating these high pressure hot gases will be discussed later herein, but at this point attention is concentrated on the variety of ways these pumps are utilized in a total energy system for low temperature heat utilization in a community for plant and animal life.

Figure 1:
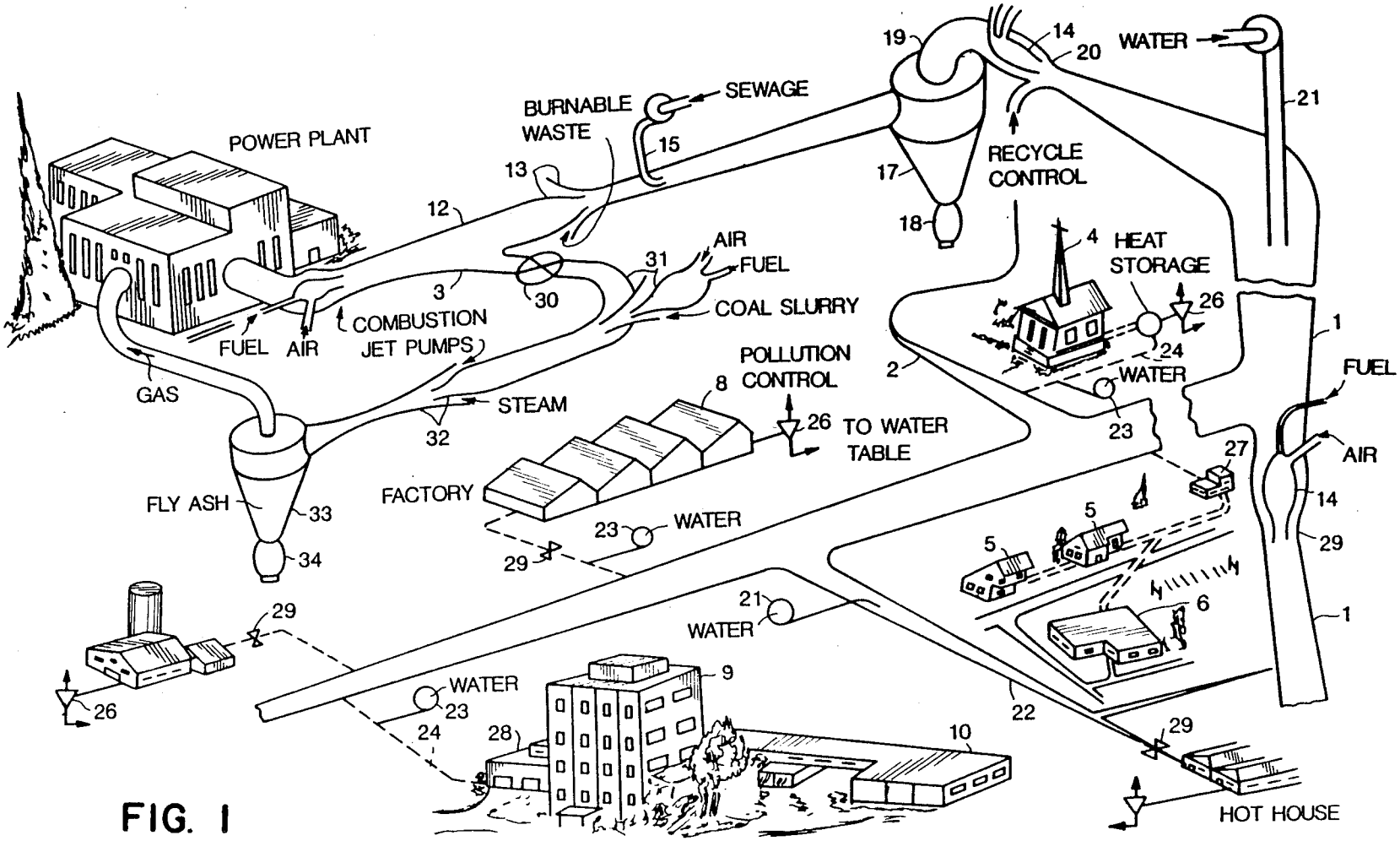
FIG. 1 is a panoramic schematic of the total energy system being applied to a community with a variety of heating uses.

Accordingly attention is directed to FIG. 1. As can be seen, the conduit 1 and its branch lines serve many functions; and except for recycle control off branch 2 and the optional addition of gases for coal gasification in branch 3, all the other branches as shown deliver a mixed flow of gases, vapors and very fine particles at low temperature for the church 4, homes 5, school 6, farm 7, factory 8, apartment 9, motel 10, and hot house 11. Of course all similar low temperature heat uses such as for shopping centers, recreational centers, industrial parks and the like, not shown, are serviced in the same way.

The sources of low temperatures heat are power plant exhaust gases discharging in duct 12, burnable waste ingested in combustion jet pump 13 and fuel provided in the high pressure chambers 14 which power the jet pumps. The energy for compressing the air for chambers 14 is delivered by electric or internal combustion engine power, not shown. In the latter case, the exhaust gases from the engine are ingested in a manner similar to that shown for burnable waste.

Sewage sludge is pumped in at line 15 and its water content flashes to steam in duct 16. The temperature in this duct is either controlled to dry the sludge or burn it. If dried, it would be separated in cyclone 17 and periodically discharged by lock hopper 18. In either case the resulting hot gases, water vapor and fine non-combustible particles would discharge from duct 19 where the flow is boosted in pressure and temperature by combustion jet pump 20, the external tube structure of which fairs in with and becomes the beginning of main conduit 1. The mixed flow at this point is at very high temperature up to 1500° F., and higher. The hot gases are reduced in temperature by pumping in water, at lines 21, which is also needed to augment the flow. The water accordingly flashes into steam and the conduit at this point in effect becomes a low pressure boiler supplyig a mixture of steam, non-condensible gases, and fine particles for heating homes, and other community buildings earlier defined, through branch lines 2 and 22. Additional water is pumped in by centrifugal pumps 21 and 23 at points of final discharge for end uses in lines 22 and 24.

In one mode, the mixture flows continuously through a heat storage facility 25 (shown symbolically) which transfers the required heat to a recirculating hot water or hot air system of conventional types for heating the Church 4. The mixed flow is next ducted to a gas separator 26 (shown symbolically). The non-condensible gases are next treated for pollution control (not shown) and discharged to the atmosphere. The condensate is treated beforehand for pollution control and allowed to drain freely to recharge the water table.

In another mode, for example at the factory 8, the heating medium is used in continuous flow through the factory or process and then flows to the gas separator 26. In the case of the small residential settlement shown as homes 5 and school 6, the building 27 serves to house the water pump, storage facility and gas separator and related controls. Building 28 serves in the same way to supply heat to the apartment 9 and motel 10.

The barn 7 and hot house 11 are serviced in the same way as the factory 8 where the heating medium is allowed to flow continuously through radiators inside the buildings before gas separation and pollution control. The radiators (not shown) may be arranged as necessary in series and in parallel. Control in these cases is achieved by throttling the main flow valves 29 and subordinate valves (not shown) in radiator branch lines inside the buildings.

In those cases where the heating medium flows continuously through radiators inside the building, as shown for the barn 7 for example, the use of the separator 26 is eliminated by piping the effluent to rejoin the parent flow at a lower pressure downstream.

An alternate mode for tall buildings, instead of that shown for building 9, for example, is to cause the heating medium to flow up through the building (exposing selective runs for radiative heating) to finally discharge at the roof in a separator 26 (not shown). Of course, this up-flow orientation may also employ parallel branches which run to one or more outlets at the roof.

The entire conduit and branch system is designed for continuous flow-through of all solids, liquids and gases in the mixed flow, making certain that there are no stagnation locations for gases and vapors to rise out of stream flow nor for solids to settle below stream flow. Side stagnation locations are also avoided or minimized.

The continuous flow-through required depends on maintaining or raising system pressure. This is accomplished by providing combustion-jet pumps 29 at appropriate locations as booster pumps.

The coal gasification system, as earlier stated, does not of necessity require the flow from branch line 3, which flow may be stopped by valve 30. Further, jet pumps 31 and 32 are similar in design and function to jet pumps 20 and 13 respectively, and the cyclone units 33 and 34 are similar in design and function to cyclone units 17 and 18. However, for a better understanding, a still further description of coal gasification will follow the more detailed discussion of combustion-jet pumps.

COMBUSTION JET PUMP

Figure 2:
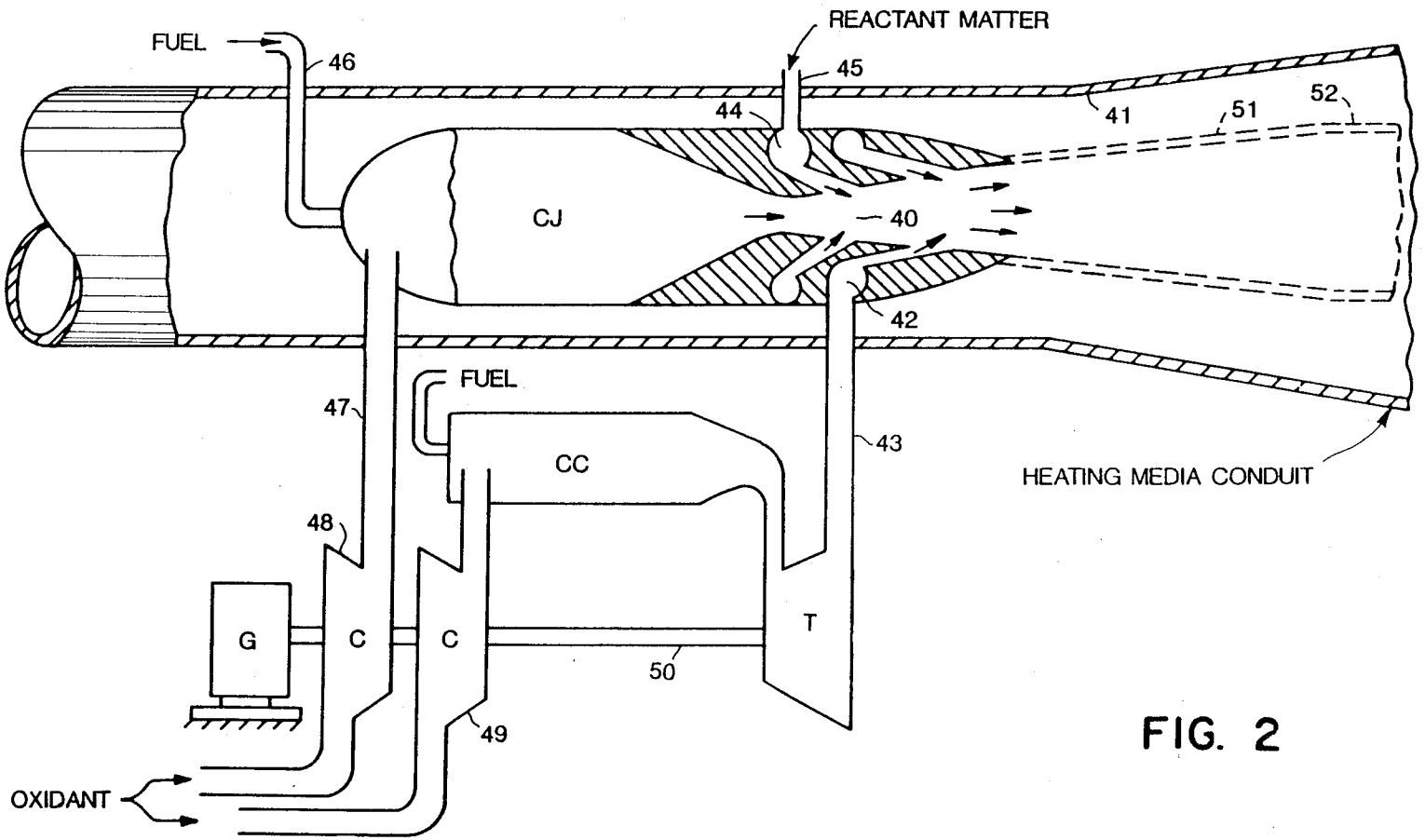
FIG. 2 is a diagrammatic schematic of a combustion jet pump being powered by a gas turbine showing how the exhaust gases from the turbine are being ingested by the jet pump and how some shaft power is used to generate electricity for local use.
Figure 3:
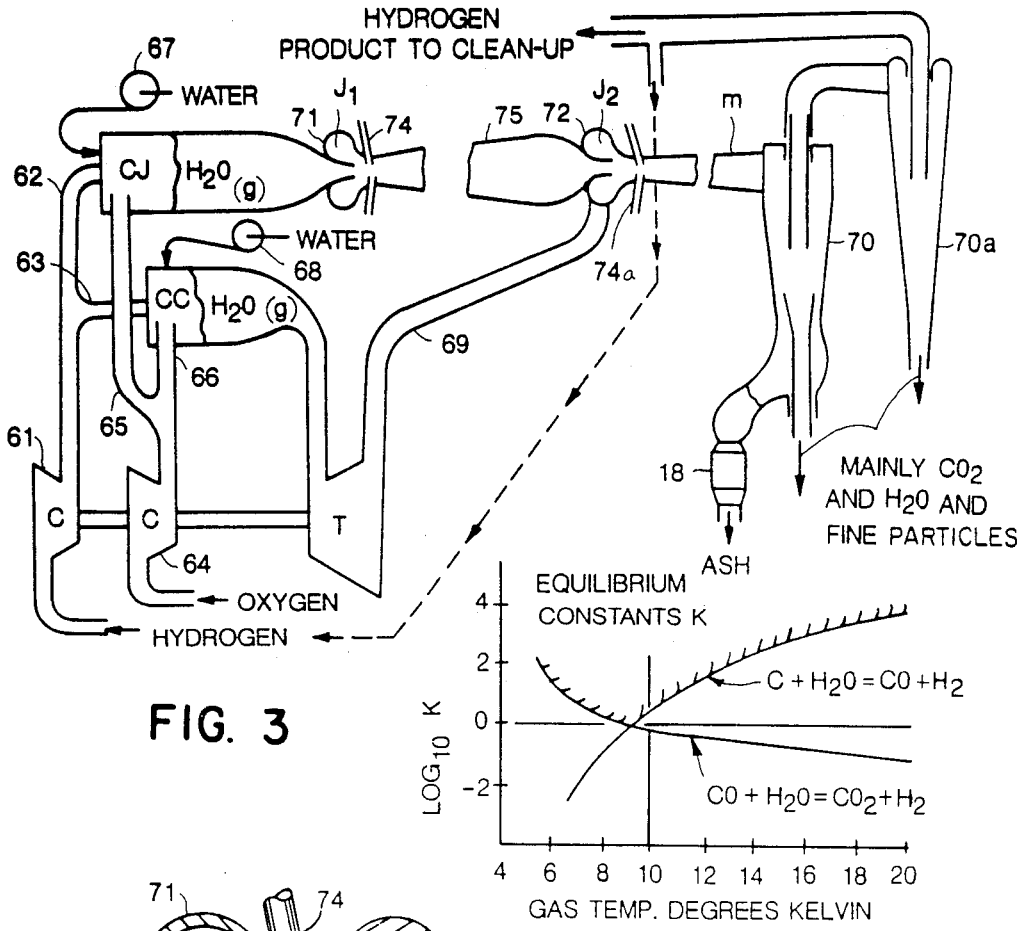
FIG. 3 is a diagrammatic schematic of a combustion jet pump for producing synthesis gases followed by another jet pump to effect the shift reaction.

The combustion-jet pumps shown in FIGS. 2 and 3 may be powered by gas turbines. These are the preferred embodiments, because the exhaust gases as will be seen are readily ingested to become part of the heating medium. In these figures the compressor is indicated by the letter C, and the driving turbine by the letter T. Combustion chambers in which regular fuel or pollutants are mixed and burned with compressed air are marked with the letters CC, if they power the turbine, but are marked with the letters CJ when coupled to power a jet pump. Directions of flow are indicated by arrows, and various legends appear on the figures to aid in clarity of presentation.

Turning now to FIG. 2, which is schematic and functional, the high temperature combustion chamber CJ is shown close coupled to the jet pump 40 and streamlined for insertion into conduit 41 in order to serve as a booster pump for the gases already flowing in the conduit.

The jet-pump 40 is constructed integral with scroll 42 (shown in cross-section) for ingesting the turbine exhaust gases through line 43. Similarly, burnable matter such as air-entrained shredded waste is ingested through the scroll 44 from line 45. The scrolls are similar to centrifugal pump scrolls and serve as secondary ports to the jet pump.

The high pressure combustion chamber CJ is fueled by any fuel through line 46. Combustion air (or other oxidant) is generally supplied through one branch and secondary air through another branch. For simplicity they are symbolically represented here as flowing from one high pressure delivery line 47 from the gas tubine compressor 48. The gas turbine combustor CC is similarly fueled and powered by compressor 49. The compressors 48 and 49 are on a common shaft 50 driven by turbine T. Shaft 50 is extended to additionally power an optional electric power generator G.

In a simpler mode the two compressors 48 and 49 are replaced by a single compressor. In this case the air would be distributed to the two combustors CC and CJ by appropriate branching, and a turbo charger serves the turbine and compressor function. Standard diesel engine turbo charges available in a wide-range of sizes can accommodate a wide flow range for this purpose.

In this mode, in particular, water instead of excess air is introduced into the combustor CC for lowering the turbine inlet gas temperature to the turbo charger as well as to augment the turbine inlet flow with superheated steam. This augmentation facilitates matching the most efficient turbine flows to standard turbine wheels. And further, this operates to deliver more oxidant to the combustor CJ thereby increasing its power potential in a large way. In effect, the turbo-charger becomes a psuedo steam turbine compressor. The thermodynamic leverage that obtains by operating the chamber CJ up to stoichiometric temperature levels more than offsets in some applications the drop in thermal efficiency when the latent heat in the steam is not useable. This is not the case when the steam is required in the system as part of the heating medium for low temperature utilization.

The gas turbine powered combustion-jet pump of FIG. 2 can operate as an independent unit to supply a heating medium for a single heat application or a small branch system in comparison with the extensive community distribution depicted in FIG. 1. In this mode, the conduit 41 is eliminated and replaced by continuing-mixing tube 51 (shown in phantom) which fairs in with jet pump 40 on one end and continuing-duct 52 on the other end for delivering the heating medium to the point of heat utilization at temperatures over a wide range up to stoichiometric levels. The combustion of burnable matter through scroll 44 is guaranteed by operating the primary jet from combustor CJ above the ignition temperature of the burnable matter. Insulation and cooling jackets are ommitted throughout from the drawings for simplicity.

The primary jet may fire with excess oxygen in combustor CJ to supply the oxygen needed to incinerate the pollutant fed secondarily. Alternately, the primary stream may be fuel rich in order to consume excess oxygen in the secondary flow.

Water may be injected into, and mixed with, any primary reactant at any convenient point and/or secondary stream to augment the flow and modulate the effluent temperatures. Water is preferably injected by any auxiliary powered pumping means so as to minimize depleting system line pressure.

It is to be noted that combustion thus incited inside the jet pump 40 converts the pump complex into a sequential compression-combustion-expansion-combustion-expansion engine. It additionally generates power without operating expense by energy conversion from the fuel or pollutant that would be anyway burned for its heat content in sequential processing.

The capability of the pump complex, just described which permits varying the combustion reactants at both ends of the power jet particularly with water addition and the facility for entraining particulate matter, is ideally suited to enhance the endo-thermic and exothermic reactions in fuel gasification processes. Of course, any gas so generated is readily available to fuel the engine powered jet pumps.

COAL GASIFICATION

The invention is described to gasify coal particles which is one of the most complex fuels to gasify. Accordingly, those versed in the art will know when and how the broader aspects of coal gasification by this invention apply to other fuels. It is well known, for example, that gas companies supplement their regular gas by gasifying petroleum products to cover shortages in inventory. For this purpose, the term 'particle' is considered to include liquid particles or droplets, as well.

In general with respect to FIG. 2, the combination of elements shown function as a coal gasifier when gas or steam entrained coal particles or a coal/water slurry is ingested or control-fed into secondary scroll 44 through line 45 to be entrained and boosted in pressure by the power jet. The combustors CC and CJ are fired by any fuel, providing preferably that the combustion reactions are reduced in temperature from stoichiometric levels by water injection. The capability to introduce water through these three paths facilitates the material balance for the water gas reaction, with respect to the carbon content of the coal:

$$C+H_2O_{(g)} \rightarrow CO+H_2$$

Accordingly, these synthesis gases would be the principal products. The entrainment is tailored to keep the ash content dispersed and suspended until the ash particles pass through the plastic state and are cooled to the point of solidity when they are removed by the cyclone 33 in FIG. 1 or by any other inertial method.

Referring again to FIG. 2, when the combustors CC and CJ are supplied with oxygen, the resulting gasifier products are medium BTU gas (MBTU) containing $CO_2$ and some hydro-carbon fractions in addition to CO and $H_2$. When air is used, nitrogen and some nitrogen compounds are added to the product mix and the result is low BTU gas (LBTU).

The invention, further with respect to FIG. 2, may be practiced to pyrolize coal. In this mode, it is preferable that no free oxygen be introduced into the reaction zone down stream from the power jet, and that the heat for pyrolysis is supplied by a relatively inert primary jet. Accordingly, the reaction in combustor CJ (and in combustor CC when used) is temperature controlled by injecting water into the combustor and the water becomes super-heated steam. Pyrolysis is a fast reaction compared with reacting all the carbon in the coal. Accordingly, the volatile gases representing hydro-carbon fractions are spun off by a cyclone which separates the residual carbon, called char, with the ash content for reprocessing. The char particles are then fed into another jet pump system as in FIG. 2 which was already described for producing the synthesis gases ($CO+H_2$).

Figure 4:
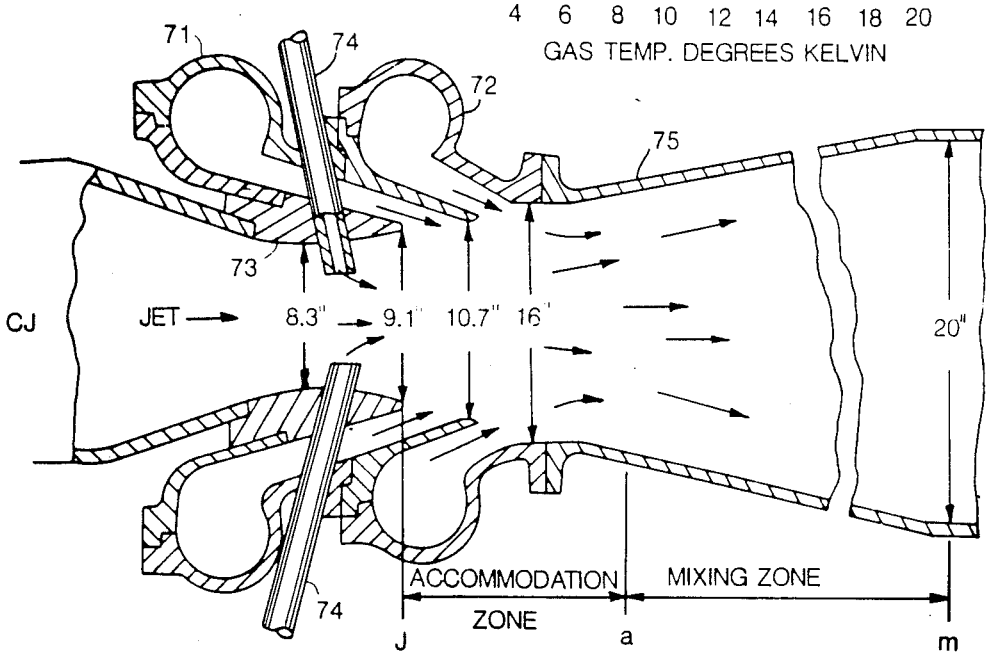
FIG. 4 is a part cross-section of a combustion jet pump showing the primary and mixing zones where combustion can take place.

In the production of synthesis gases, the introduction of an oxidant through a third secondary port (not shown in FIG. 2, but similar in design and adjacent to scrolls 42 and 44) operates to create more heat through secondary combustion, thus generating more steam to gasify more coal. FIG. 4, which is a slightly modified version of how 3 secondary flows are introduced, illustrates the oxygen feed into the jet-entrainment zone.

All of the foregoing modes of gasification are endothermic. Accordingly the heat of reaction must at least be supplied by the combustion of fuel in combustor CJ, and optionally by ingesting oxidant secondarily, as just described and/or by ingesting the turbine exhaust gases, when the turbine is used to compress the oxidant for combustor CJ.

In still another mode, pyrolysis is practiced by firing hydrogen in the combustor CJ of FIG. 2 whereby the combustion temperature is reduced from stoichiometric level by operating with a hydrogen rich mixture. In this way, the power jet would bombard and entrain and simultaneously thereby hydropyrolize the carbon content of the coal. In this manner the hydrogen combines with the volatiles increasing the formation of hydrocarbons.

The invention is also practiced in the shift-reaction process shown schematically in FIG. 3. The synthesis gases ($CO+H_2$), produced as earlier described, proceed to a sequent non-combustion jet pump 70, which is powered by the available energy residing in the synthesis gas stream. This jet pump ingests steam which is jet-entrained to produce the following shift reaction:

$$H_2+CO+H_2O_{(g)}\rightarrow CO_2+2H_2$$

Accordingly, the system becomes a hydrogen generator, and the process is simplified by recycling a fraction of the hydrogen, after gas separation and purification (not shown), through compressor 61 to fire combustor CJ and CC through ducts 62 and 63 respectively. Oxygen is compressed in compressor 64 and is respectively fed to the same combustors through ducts 65 and 66. As with the previous gasification processes, water pumps 67, 68 inject water into the combustors to augment the flow and lower combustion temperatures. When hydrogen is used with oxygen to fire combustor CC, the entire turbine exhaust in conduit 69 is super-heated steam. In this way it becomes the required steam which is ingested by jet pump 70 for the shift-reaction. However, steam may be supplied at jet pump 70 by any other means.

For simplicity single stage turbines and compressors are shown in FIGS. 2 and 3. However, multiple state turbines and compressors may be used when necessary to meet higher process pressure requirements without departing from the invention.

The invention is further practiced to minimize the need of catalysts and to operate below the usual pressure level practiced by competing processes. The intensity of energy transfer from the power jet to the secondary flows by this invention is accordingly depended upon to speed up and enhance gasification reactions. This aspect is discussed with respect to FIG. 4, which is a cross-section of the jet-entrainment zone. Three secondary ports are shown. The oxygen port 71, is optional. Oxygen is introduced, as mentioned earlier, when it is desired to effect combustion down stream to generate more steam and gasify more fuel. The exhaust gas port 62 is also optional. This is omitted when the oxidant for the combustor CJ is compressed by an electrically driven compressor. Otherwise, and except for the shift-reaction process, it admits exhaust gases from the engine driven compressor. In the shift-reaction process, the exhaust gas is directed to the sequent jet pump 70 of FIG. 3, as earlier described.

The preferred embodiment for most processes when oxygen is available is to effect combustion in combustor CJ. When exceptionally high pressures are required, the pressure is developed by admitting steam or super heated steam from a high pressure boiler. In this case, additional heat is added down stream of the jet nozzle 73 by admitting oxygen or air through port 71, and/or by injecting fuel and oxidant in combustor CJ. When a boiler is fired to pressurize the chamber CJ, the stack gases may be ingested through port 72 in most processes for low BUT gas production. The stack gases containing nitrogen and nitrogen compounds are of course not introduced into the system in medium and high BTU gas production processes. An alternate mode with boiler generated steam is presented later.

The secondary port 74, is used for feeding in fluidized coal particles (or other fluid for gasification.) For coal particles, the preferred fluidizing medium is water. Port 74 represents 2 or more tubes radially oriented and evenly spaced from each other. Tubes are shown for simplicity and to contrast them from the scroll like ports 71 and 72, and further because the volumetric rates of a coal slurry require comparatively small cross-sectional flow areas in order to maintain fairly fast velocities in the tubes 74. The speed is necessary for delivering a relatively cold flow into the hot jet which simultaneously helps to keep the tubes 74 clean. Accordingly the velocities in the tubes may range from 10 to 100 feet per second. This wide range permits a wide flow range for any fixed tube 74 arrangement. The flow is preferably controlled over the wide range. This same flexibility is also characteristic when oxygen and/or exhaust gases are ingested by the pump, or pumped in as controlled flows.

This wide range in secondary flow is permitted because the secondary flow velocities are any way negligible in the preferred jet pump embodiment where the power-jet is nearly sonic. When the critical pressure ratio is exceeded, that is when the static pressure just upstream from nozzle 73 is more than about twice the pressure just down stream, then the velocity at the throat 73 is sonic. With a diverging nozzle, as shown, the flow expands super-sonical. As super-sonic flow is unstable in these circumstances a shock wave prevails in the expansion zone of the nozzle or just beyond it. The flow then becomes subsonic and obeys the gas laws for subsonic flow. The flow accordingly just down stream of the jet nozzle 73 will be referred to as near-sonic. Sonic speed varies with gas temperature according to the square root of the absolute gas temperature. The high pressure chamber CJ is designed for combustion temperatures up to 4000° R. and higher. At the 4000° R., the following gases develop the sonic velocities indicated:

Carbon Dioxide: 2287 fps
Steam: 3621 fps
Oxygen: 2818 fps
Air: 2981 fps

Further, the nozzle 73 of fixed diameter will produce a sonic velocity for any high pressure in the combustor CJ so long as the above mentioned critical pressure ratio is maintained as a minimum. And so, for this part also with a fixed nozzle opening, a wide range of flows may be effected by increasing the pressure in combustor CJ.

In view of all this, one of the main features of the invention is to accelerate the coal particles by the jet from practically negligible velocities to near sonic speeds, thereby effecting through drag tremendous heat and mass transfer from jet to wetted coal particle. As the effective molecular velocities in kinetics are of the order of the speed of sound, the resulting chemical reaction is enhanced kinetically as well as by rapid heat and mass transfer. Further, this rapid transfer of heat operates to fragment the coal particles from the sudden expansion of gases and vapors within the particles.

The accelerator section 75 just down stream from the secondary section is shown diverging to account for heat addition just down stream of nozzle 73. Otherwise, a constant area duct is suitable in some cases for the accelerator length depending on the chemical reactions involved. In either case, the flow beyond the accelerator section may be ducted in a diffuser which diffuses the flow, say, from 2000 to 200 fps in a relatively short distance. At this point unreacted particle matter, already close to the gas flow velocity, decelerates at a much slower rate than the gas flow, thereby generating counter slip velocities of significant magnitude to speed up completely gasifying the particle.

The production of nearsonic velocities for slip production will be discussed with respect to sequent jet pumps. This sequence has been shown to occur in FIG. 1 where jet pump 13 is sequent; and in FIG. 3 for the shift reaction where jet pump 70 is sequent. These pumps differ from booster jet pumps (such as jet pumps 14 in FIG. 1 which are locally powered) in that they are powered by the expanding jet and mixed flow through a diffuser from the previous jet pump.

When the preference is for sonic velocity to occur at the throat of the sequent pump, it is necessary to operate the CJ chamber of the advance pump somewhat higher in pressure than the pressure producing the sequent jet. The reason for this is that part of the flow energy converts to heat from shock waves, accelerating particles, ingesting secondary flows and duct friction. Accordingly the static pressure behind a sequent jet nozzle must be of the order of twice static pressure just down stream of the jet nozzle to produce sonic velocity at the throat as earlier described. Sequent pumps can be one or more so long as the pressure in the first jet pump is high enough to support the down stream energy requirement. The cascading pressure support scheme is of course boosted when combustion is arranged down stream of jet 73.

Very high pressures, as earlier stated, are readily available when steam is generated in a boiler and this mode for pressurizing chamber CJ is applied when oxygen is precluded or minimized for economic reasons. In order to apply this mode the boiler exhaust gases should be precluded from the gasifier jet pump and the super heated steam from the steam generator should be heated to temperatures above 1600° F. by indirect heat exchange before it enters chamber CJ. The jet pump operation in this way is applicable to all gasifying modes herein before described except for effecting combustion in chamber CJ. In this way oxygen may be completely omitted from the gasifier and, at the most, minimized in secondary flow. The preferred source of the indirect heat for the high pressure steam is to generate high pressure hot gases up to stoichiometric levels, using air and any fuel in a gas turbine powered hot gas generator per my U.S. Pat. Nos. 3,919,783 and 4,146,361. After the hot gases so generated transfer their highest level heat to the steam, the hot gas flow is staged to cascade thermally:

1. to super heat the steam in the steam generator
2. to supply the latent heat for the steam
3. to preheat the combustion air
4. and finally, at the lowest temperature level, to preheat the feedwater for the boiler or steam generator.

As the heat exchange sequence takes place indirectly under pressure, a jet pump is introduced at the suitable temperature level for entraining the gas turbine exhaust gases to mix with the other gas turbine generated hot gases. In this way my patented inventions, above stated, are practiced in combination with the jet pump gasifier of this invention to utilize practically all of the heat supplied, by the energy balance with heat transfer as earlier stated, to the point of low temperature utilization, again in the practice of this invention.

The advantage of precluding oxygen in fuel gasification processes, with the state of the art at this point in time, is the tremendous saving in capital investment. Oxygen plants cost from 10 to 20 times more than the gasifier plants. For example, a plant for supplying oxygen to process 600 tons/day of coal for yielding medium BTU and synthesis gases would cost from 7 to 12 million dollars.

The production of hydrogen by this invention provides another mode for precluding free oxygen and utilizing air instead. Accordingly the shift reaction, delivers mainly $H_2$, $CO_2$, and $N_2$. The ash may be removed in a prior operation or at the same time as the carbon dioxide and nitrogen which are inertially separated by virtue of their large molecular weight differences with respect to that of hydrogen. As the gas mixture must anyway be cooled, the heat, for this purpose, is effectively removed by a heat exchanger located inside a cyclone separator. The cyclone is the preferred inertial method, because the wide range of exceptionally high velocities, available by this invention, develop exceptionally high separating efficiencies. The cooling is provided at least toward the outer peripheral surface of the cyclone so that the resulting thermal differences operate to enhance the separation. The $CO_2$ of course may be removed by well-known chemical means ultimately to yield byproduct free nitrogen.

A NUMERICAL EXAMPLE OF AN OXYGEN BLOWN GASIFIER

Stoichiometric Relations

The cross-sectional areas of the jet pump (FIG. 4) sized to process 1200 Tons of coal per day are developed in this example. The example also applies to FIG. 2, at least to show how the turbine exhaust, 43, enters the jet pump at port 42. Accordingly, port 42 in FIG. 2 corresponds to port 72 in FIG. 4. Further with respect to FIG. 2, the high temperature combustion chamber, CJ, is fired with a coal slurry fed through tube 46, with oxygen supplied by compressors 48 and 49 to combustors CJ and CC respectively. These feeds are schematic. Any pressurized coal-slurry combustor can be used. The fuel for the gas turbine combustor is any suitable fuel, but for analytical simplicity is considered here to be the equivalent of coal. The temperatures in both combustors are controlled downward stoichiometrically by introducing water or steam. This example involves water. Accordingly the products of combustion in chamber CJ are shown to be $CO_2$ and steam. The auxiliary feeds are more explicitly shown on FIG. 4 and consist of additional coal slurry entering through tubes 74 and additional oxygen through port 71. Accordingly the typical chemical equation for this gasifying mixture is High Temp. Jet $[2CO_2 + 5H_2O_{(g)}]_{2100° K.} +$ -continued Turbine Exhaust
$[.6CO_2 + 3.5H_2O_{(g)}]_{900° K.} +$ Auxiliary Feed
$[14C + 2.5H_2O_{(l)} + 4O_2]_{298° K.} \rightarrow$ SYN GAS
$[6.6CO_2 + 10CO + 10H_2 + H_2O_{(g)}]_{1300° K.}$ It is evident that the volatile components and the ash content of the coal have been omitted. This is for simplicity. In general, the gas products shown may be considered augmented by the volatiles and ash. However, the equation, as it stands, applies explicitly to gasifying char. It is well known that some gasifier processes gasify the entire coal particle and others separate the volatiles to gasify the char separately. This invention can be practiced in either mode.

The above equation henceforth will be referred to as the Main Equation.

Thermochemical Relations

The Main Equation used throughout as a basis for this numerical example is used here to develop an accounting of the heat entering the jet pump and leaving at station m, the stoichiometric limit. These points of entering and leaving are taken as the terminal points of a control volume. All physical, thermal, and chemical activity is considered to take place within this control volume, with neglible radiation loss to the outside.

The difference between the heat entering and the heat leaving is heat that has converted to chemical energy or fuel value in the mass outflow. The net effect of the Main Equation is exothermic, but within the control volume, the gasification reaction is essentially endothermic whereby the endothermic requirement is more than met (as it must be for useful purpose) by the combustion of fuels in advance of the jet and (in this case, also) sequent to the jet exit.

The high temperature jet shown in the Main Equation is the result of combining two moles of carbon in particle form and two moles oxygen in the presence of five moles of water. Similarly, the turbine exhaust results from the combustion of 0.6 moles of carbon and 0.6 moles of oxygen in the presence of 3.5 moles of water. In both cases, the oxygen is compressed to 3.2 atmospheres by the gas turbine compressor. The high temperature jet continuously ignites 4 moles of carbon in the Auxiliary Feed to fire with 4 moles of oxygen. For the purpose of heat accounting, the Main Equation is consolidated as follows:

$$[16.6C + 6.6O_2 + 11H_2O_{(l)}]_{298° K.} \rightarrow$$

$$[6.6CO_2 + 10CO + 10H_2 + H_2O_{(g)}]_{1300° K.=2340° R}$$

Heat Accounting

Figures in parentheses are heats of formation in Kcal/gram-mole (Text: Chemical Process Principles by Housen et al., Wiley Press, N.Y. 1962).

$$16.6(2.6) - 11(68.3)32\ 6.6(94) - 10(26.4) - (57.8)$$

Heat in exiting stream $\Delta H_m = -234K$ Cal/10 Sec or 23.4(1800)=42120 BTU/sec.

Reaction End Temperature

Try 1100° C.

Here from same text, the values in parentheses are mean molal and heat capacities in gram-cal/(gram-mol) K°)

| | | | |
|---|---|---|---|
| $CO_2$ | 6.6(12.10) = | 79.86 | $T_m = \frac{234000 \text{ Cal}}{237 \text{ Cal/degree}}$ |
| CO | 10(7.65) = | 76.50 | |
| $H_2$ | 10(7.17) = | 71.70 | |
| $H_2O$ | 1(9.39) = | 9.39 | $T_m$ = 987° C. |
| | | 237.45 | Therefore $T_m$ = 1300° K. (approx.) = 2340° R. |

Jet Mass Flow

The mass flow of the jet is found by relating the mass flow of the coal, 1200 TPD, to the foregoing Main Equation:

$$\frac{1200\ TPD \times 2000\ LB/T}{24\ hrs \times 60\ min. \times 60\ sec.} = 27.8\ LB/SEC$$

$$2C + .6C + 14C = 16.6 \therefore 16.6 \times 12 = 199.2 \text{ LBS of Carbon.}$$

Assume the carbon content of coal at 71.6% for convenience.

$$\therefore 71.6\% \times 27.8 = 19.9 \text{ LBS/SEC Carbon}$$

This establishes the Main Equation requiring, 199.2 LBS of Carbon total, as representing a 10 second flow.

Accordingly, the jet mass flow is 17.8 LBS/SEC, from $G_j = [2 \times 44 = 88] + [5 \times 18 = 90] = 178$ LBS of Carbon in 10 seconds.

44 and 18 are the respective molecular weights (LBS/MOL) of $CO_2$ and $H_2O_{(g)}$.

Jet Nozzle Design from Gas Dynamics

The next step is to compute the nozzle characteristics based on Mach 1.5 and a stagnation pressure, $P_o = 3.2$ atm in combustor CJ. The corresponding temperature $T_o$ is taken as 2100° K. (approx. 3800° R.). $T_o$ and $P_o$ are independently established by combustor CJ and gas turbine compressor respectively. The following chart is developed from Keenan and Kaye Gas Tables. The symbols without subscripts in the chart represent conditions at the nozzle discharge. Supporting computations follow the chart. Mach 1.5 is shown because it yields a pressure jet below atmospheric (0.947 atm) at the jet discharge which is sometimes preferable.

| M | M* | A/A* | $P/P_o$ | $\rho/\rho_o$ | $T/T_o$ | T | a | V | A | P |
|---|---|---|---|---|---|---|---|---|---|---|
| 1 | 1 | 1 | .5644 | .6209 | .9091 | 3455 | 3087 | 3087 | 54* | 1.80 |
| 1.5 | 1.421 | 1.205 | .2959 | .3625 | .8163 | 3100 | 2918 | 4377 | 65 | .947 |

$$\rho_o = \frac{P_o}{RT_o} = \frac{3.2 \times 144 \times 14.7}{71.4 \times 3800} = .025 \frac{LBS}{FT^3}$$

71.4 is the specific gas constant for the mixture $2CO_2 + 5H_2O$. The densities $\rho_1$ and $\rho_{1.5}$ are developed from the table for specific Mach $\rho$'s by:

$$\rho_1 = 0.6209 \times 0.0252 = 0.0155$$

$$\rho_{1.5} = 0.3625 \times 0.0252 = 0.0090$$

Accordingly, the area A*, representing the throat area of the nozzle for the mass flow G=17.8 LBS/SEC at Mach 1 is:

$$A^* = \frac{17.8/10155}{3087\ fps} = .370\ \text{ft}^2 \text{ or } .54\ \text{in}^2$$

The speed of sound, a=3087 fps at Mach 1 was computed from:

$$a=(gKRT)^{\frac{1}{2}}=(32.2\times1.2\times71.4\times3800^\circ\ \text{R.}\times0.9091)^{\frac{1}{2}}=3087\ \text{fps}$$

Note that the speed of sound, a, is independent of pressure and varies mainly with the absolute temperature, T. At Mach 1.5, the area A at the discharge end of the nozzle is:

$$A = \frac{17.8/.0090}{4377\ fps} = .450\ \text{ft}^2 \text{ or } 65\ \text{in}^2$$

The supersonic velocity 4377 fps=1.5×2918 fps where 2918 fps is the velocity of sound at the throat for:

$$T=0.8163T_o=0.8163\times3800^\circ\ \text{R.}=3100^\circ\ \text{R.}$$

The area A is also computed by the Keenan & Kaye function A/A*=1.205.

Accordingly: $A=1.205\times54\ \text{in}^2=65\ \text{in}^2$ This shows, as is well known, that for a gas to accelerate supersonically, the nozzle must diverge.

Temperature Effect

So far the stagnation temperature has been held at 3800° R. or 3340° F. Temperature up to 5000° F. may also be considered by similar computations. On the other hand, lower stagnation temperatures are preferred to extend the practical operating range of the gasifier.

Consider $T_o$=2460° R. or 2000° F. and $P_o$=3.2 atm:

| M | A/A* | $P/P_o$ | $\rho/\rho_o$ | $T/T_o$ | T | a | V | A | P |
|---|---|---|---|---|---|---|---|---|---|
| 1 | 1.5 | .5644 | .6209 | .9091 | 2236 | 2484 | 2484 | 43 | 1.8 |
| 1.5 | 1.205 | .2959 | .3625 | .8163 | 2008 | 2354 | 3531 | 52 | .947 |

Again if the conditions at Mach 1.5 from the chart, are examined, the mass flow at the nozzle discharge is determined from the density and velocity for the nozzle discharge area of 52 in².

Accordingly:

$$\rho_{1.5} = \left(\frac{p}{RT}\right)_{1.5} = \frac{.947\times144\times14.7}{71.4\times2008} = .014\ \text{LBS/FT}^3$$

$$G_j = (\rho AV)_{1.5} = .014\times\frac{52\ \text{in}^2}{144}\times3531\ fps = 17.8\ \text{LBS/SEC}$$

This checks the original condition. However, if the nozzle held the dimensions of the previous chart, (A*=54 in² at the throat and A=65 in² at the discharge end) but for the temperature conditions of the second chart then the mass flow would increase proportionately with respect to throat areas. Hence, $$G_j=54/43\times17.8=122.35\ \text{LBS/SEC}$$

Pressure Effect

The foregoing demonstrates how the mass flow increases when the stagnation pressure $P_o$ is held and the stagnation temperature, $T_o$ decreases. On the other hand, the mass flow decreases when the pressure is lowered. The lower limit for sonic conditions is set by the critical pressure ratio: $P/P_o$=0.5644.

In order to maintain an accommodation pressure P just below atmospheric, for example, the lowest stagnation pressure P yielding a sonic velocity is:

$$P_o=P/0.5644=0.947/0.5644=1.68\ \text{atm approximately.}$$

Still lower primary or stagnation pressures would produce subsonic velocities at the throat and the divergence would now operate to decrease the velocity further, while increasing the static pressure. This is also true after shock waves with higher primary pressures providing the receiver diverges to decrease the flow velocity.

Though more complex in design with the complexity in the zone of high temperature and extreme velocities, there is some merit for a design with a variable throat opening. However, as the computations show, there is a fairly practical operating range which results from varying the temperature and pressure in the combustor, for a fixed throat opening and divergence. In effect, the combustor designed with a fixed throat opening also serves as a dependable metering device simply by monitoring the temperature and pressure of the combustor CJ.

Fliegner's formula is well known for this purpose. Using k as 1.2 and R as 71.4, its coefficient, C, becomes 0.435. Therefore:

$$G_j = \frac{.435A^*P_o}{(T_o)^{\frac{1}{2}}}$$

Inasmuch as supersonic flows are caused to breakdown in the practice of this invention for practical reasons yielding to shock and nearsonic velocities as above-described, the area of the throat becomes the significant design parameter for establishing the mass flow, represented by the Fliegner equation.

The coefficient, C, for other k's and R's respectively representing other gas mixtures would be determined by $$C = \left[\frac{gk}{R}\left(\frac{2}{k+1}\right)^{\frac{k+1}{k-1}}\right]$$

So far the analysis has been based on principles of gas dynamics which are well known by those versed in this discipline. The details have been presented to clarify one of the main objectives of the invention which is to develop at least most of the available energy for a sequent process by initiating a mixture of reactants at exceptionally high temperatures and high pressures to develop a jet at near sonic velocities to admix with other reactants secondarily fed into the jet pump. As the temperature is developed by burning or firing combustibles under pressure, the apparatus is effectively a combustion-jet-pump.

It remains next to develop the significant dimensions of the jet pump for admitting the secondary flows represented by "Turbine Exhaust" and "Auxiliary Feed" in the Main Equation.

While it is another objective of the invention to transfer momentum and heat from the primary jet at very high velocities to the secondary streams at negligible velocities, it is anyway preferrable, even for accommodation pressures below atmospheric to pump in and meter all secondary flows. Since these flows may enter at any negligible velocity, fixed entry port dimensions will accommodate a wide range of secondary flows. This is a distinct feature of the invention.

AUXILIARY FEED—SLURRY MASS FLOW AND ENTRY TUBES $$[14C + 2.5H_2O_{(1)} + 4O_2]_{298°\,K.}$$

Slurry tube dia. may be any practical dimension, so that the stream velocity keeps the tubes clean.

The oxygen part is treated separately later as an additional auxiliary feed.

(a) Water: 2.5(18)=45 LBS/10 SEC=4.5 LBS/SEC ∴Vol=4.5/62.4=0.072 cfs (b) Carbon: 62.4×1.5=03.6 LBS/ft$^3$; 14C=14×12=168 LBS/10 SEC=16.8 LBS/SEC (c) Coal:

$$\frac{16.8\ \text{LBS/SEC}}{71.4\%\ \text{C}} = 23.5\ \text{LBS/SEC} \therefore \frac{23.5\ \text{LBS/SEC}}{93.6\ \text{LBS/ft}^3} = 0.25\ cfs$$

∴Slurry Vol. =0.072+0.25=0.322 cfs;

Considering a slurry velocity of 600 feet per minute sufficiently clean sweeping; the flow area is:

$$A_{SL} = \frac{.322\ cfs}{600/60} = .032\ \text{ft}^2 \text{ or } 4.64\ \text{in}^2$$

Designing to a nominal 6 in$^2$ area breaks down into two 3 in$^2$ area tubes or preferably three 2 in$^2$ tubes uniformly spaced around the jet nozzle and shown in cross-section as items 74 on FIG. 4.

AUXILIARY OXYGEN INTO JET PUMP

In this analysis, the oxygen is considered delivered just under atmospheric pressure at ambient temperature. However, it can be compressed conveniently to higher pressures by a downstream turbo charger receiving the products stream leaving the cylcone. Though oxygen in the Main Equation is shown with the coal slurry it is preferably fed separately into port 71 of FIG. 4.

(a) Mass Flow $$4O_2 = 4 \times 32 = 128\text{lbs/10sec or } 12.8\text{lb/sec}$$

(b) Volume Flow by the Equation of State:

$$\text{Vol} = \frac{1546 \times 530°\ R}{1 \times 14.7 \times 144} = 386\ cf/\text{mol}$$

or 12 cu ft/lb 1546 is the universal gas constant in consistent units. Q=12.8 lb/sec×12 cu ft/lb=153.6 cfs The entry Port area for the oxygen flow is also not critical.

| | | |
|---|---|---|
| Therefore set $A_{o2}$ = | 25 in$^2$ | This area is annular. |
| $A_j$ = | 65 in$^2$ | This is the nozzle exit area (Dia = 9.1") |
| Total Area = | 90 in$^2$ | (Dia = 10.7") |

These areas are oriented in the vertical plane and are circular in cross-section. They are dimensioned in FIG. 4 by their respective diameters.

(c) Oxygen velocity entering jet pump $$V = \frac{Q}{A} = \frac{153.6\ cfs}{25\ \text{in}^2/144} = 885\ fps$$

This velocity also is not critical; and more or less, Oxygen may be metered in to suit a range of reactions.

TURBINE EXHAUST-SECONDARY PORT ENTRY TO JET PUMP (a)$[0.6CO_2+3.5H_2)_{(g)}]$600° K.=1080° R.

(b) $.6CO_2 = .6 \times (44) =$ 26.4 LBS Values in parenthesis are molecular weights.

$3.5H_2O = 3.5 \times (18) =$ 63.0 LBS $4.1 \times (21.8) =$ 89.4 LBS ∴ molecular wt of mixture ≃22

(c) Assume Entry Pressure Just Under 1 atm.

(d) Mass Flow $0.6CO_2+3.5H_2O_{(g)}$=89.4 lbs. of mixture per 10 seconds or 8.94 lbs/sec (e) Volume Flow $$\text{Vol} = \frac{1546 \times 1080}{14.7 \times 144} = 788.8\ cf/\text{mol or } 36.2\ cf/\text{lb}$$

$$Q = 8.94\ \text{lbs/sec} \times 36.2\ cf/\text{lb} = 323.5\ cfs$$

(f) Secondary Port for Turbine Exhaust Entry (Item 72, FIG. 4) Any relatively low velocity is acceptable. The outside diameter of scroll nozzle entry 71, 10.7" or 0.9', is approximately the inside diameter of scroll entry 72. As with the other secondary flows, the exhaust entry velocity is not critical so long as it is reasonably low. Therefore, consider an outside diamater 16":

$$\text{Overall area} = \frac{\pi D}{4} = \frac{\pi(16)^2}{4} = 201\ \text{in}^2$$

Total previous total area (oxygen flow) −90 in$^2$

Turbine Exhaust Entry 111 in$^2$ (vertical plane basis)

Exhaust Entry Velocity:

$$V_{EX} = \frac{Q}{A} = \frac{323.5\ cfs}{111\ \text{in}^2/144} = 420\ fps$$

DOWNSTREAM VELOCITY ESTIMATE

The next step is to determine a nominal downstream velocity at the point where all the reactants become products according to the Main Equation, stoichiometrically.

Products=SYN
GAS=$6.6CO_2+10CO+10H_2+H_2O_{(g)}$ 1300° K.=2340° R.

Introducing respective molecular weights toward developing the mass flow:

(a) MASS FLOW 6.6(44)+10(28)+10(2)+(18)=608.4 lb/10 sec or 60.84 lb/sec

Recap: JET178+Exhaust 89.4+Oxygen 128 +Aux. Carbon 168+Aux. Water 45=608.4 lbs/10 sec (CHECK)

Mixture molecular weight 608.4/27.6≈22 Assume k=1.2

Estimated Downstream Pressure 25 psia. (See Momentum Transfer Relations, later)

(b) FLOW VOLUME, $$V = \frac{R'T}{P} = \frac{1546 \times 2340^\circ R}{25 \times 144} = 1005\ cf/\text{mol or } 45.7\ cf/\text{lb}$$

∴ρ=0.0219 lb/cf

Q=60.84 lb/sec×45.7 cf/lb=2779 cfs

R=1546/22=70 (Specific gas constant)

(c) Related Sonic velocity to be avoided at this point to thereby avoid choked flow:

$$a = \sqrt{gkRT} = (32.2 \times 1.2 \times 70 \times 2340^\circ) = 2409\ fps$$

(d) The actual velocity at this point is well below the sonic speed of 2409 fps as supporting calculations later show. The cross-section of the duct downstream is considered to diverge to at least to a 20" diameter at this (or prior to the) stoichiometric limit. Accordingly:

$$V = \frac{Q}{A} = \frac{2779\ cfs}{(\pi/4)\ (2_o/12)^2} = 1275\ fps$$

While a fairly high velocity is desirable at this point to insure intense mixing, again it is not critical. In fact the invention can be practiced by causing the stream to decelerate at some point down stream by a transition to a sharper divergence in the duct. As the gaseous part of the stream will respond and decelerate instantly to duct divergence, the unreacted particles will continue to accelerate by inertia. The adverse slip generated in this way also enhances the reaction. A segment divergence from 20" to 24", for example, also increases the static head and reduces the head loss due to friction.

HEAD LOSS

A nominal estimate is made of the head loss per foot of duct is made in order to obtain a sense of magnitude of the energy deliberately dissipated in this way to enhance the speed of the chemical reaction.

A gas velocity of 1000 fps is considered for a duct diameter of 24".

$$\text{Reynolds Number } N_R = \frac{VD}{\gamma} = \frac{1000\ fps \times 2'}{115.4(10)^{-5}\text{ft}^2/\text{sec}} = 17.35(10)^5 \quad \text{(a)}$$

-continued

The Kinematic viscosity for (a) is: (b)

$$\gamma = \frac{u}{\rho} = \frac{3(10)^{-5}}{.026} = 115.4(10)^{-5}\text{ft}^2/\text{sec}$$

Roughness taken arbitrarily high: (c)

$$\frac{e}{D} = \frac{1/32''}{24''} = .0013$$

The friction factor, $f$, on the basis of (a) and (c) (d)

is determined from the well known Moody diagram to be .022

$$\text{Head Loss } h_L = f\frac{L}{D}\ \frac{V^2}{2g} \text{ (where } L = 1 \text{ foot)} \quad (3)$$

$$= .022\ \frac{1}{2} \cdot \frac{(1000)^2}{2(32.2)} = 170 \text{ feet of gas}$$

$$\Delta P = \rho h_L = .0263\ \text{lb/ft}^3 \times 170\ \text{ft.} = 4.46\ \text{psf or } .031\ \text{psi}$$

HEAD LOSS DISCUSSED

Even if the reactor tube is 100 feet long, the head loss at 1000 fps is approximately 3 psi. An additional loss is caused, to start with by the shock wave at the jet nozzle.

Acording to Hickman et al on an "Analytical and Experimental Investigation of High Entrainment Jet Pumps", (NASA CR-1602, 1970):

> ". . . a nozzle designed for 350 psia supply pressure can be operated down to 200 psia with a total pressure loss due to shock waves of only 3%."

As the above losses are relatively small in the context of this invention, the remaining abundant potential affords optimum use of the cyclone downstream because of the unusually high separating forces it can effect; as well as to extend the reactor time within the cyclone in some embodiments.

ENERGY AND MOMENTUM RELATIONS

The pressure, 25 psia, used in the foregoing computations is developed as a consequence of relatively complex Energy and Momentum transfer functions. The estimate of this pressure, for fixed jet pump geometry and established flows, is therefore approximate. The established flows are based on the thermochemical relations of the Main Equation. This pressure, $P_m$, is taken at the downstream location where the chemical reactions are considered stoichiometrically complete. The subscript m connotes the end of the mixing zone along the duct for this purpose. The subscript j stands for jet and s, for secondary inflows. These computations follow:

Energy Equation

Mixed Out-flow — Jet In-Flow $$\Delta H_m = \left[Gc_pT + \frac{G}{J}\ \frac{V^2}{2g}\right]_m = \left[Gc_pT + \frac{G}{J}\ \frac{V}{2g}\right]_j +$$

Secondary In-Flow $$\left[Gc_pT + \frac{G}{J}\ \frac{V^2}{2g}\right]_s$$

-continued

| Energy Equation |
|---|
| Mixed Flow of Completed Reaction |
| $\left[60.8(c_p)(2340) = \frac{60.8\ (1270^5)^2}{64.4\ (778)}\right]_m = 23.4\ \text{Kcal} \times 1000 =$ |
| 42120 BTU/sec |

The specific heat $c_p$ of the mixed flow is accordingly computed to be 0.282 BTU/(LB)(o$_R$)

[Heat+Kinetic Energy]=40,147 BTU/$_{sec}$+1973 BTU/$_{sec}$=42,120 BTU/$_{sec}$

For simplicity and because the error is small, the temperature, $T_m$=2340° R. computed thermochemically in the Main Equation is considered to be the stream temperature after mixing. The stream is actually running colder by a difference of about 100° R. due to its kinetic energy of 1973 BTU/sec.

| Jet In-Flow From Gas-Dynamics Computations Previously Given |
|---|
| $\left[17.(8\ c_p)(3100) + \frac{17.8(4377)^2}{64.4(778)}\right] = (18.8\ \text{Kcal} - 10.52 \times$ Lat. H+ |
| $5)(1800) = 24372$ |
| $\therefore c_p = .32$ |
| $[17572]_{Heat} + [6800]_{KE} = 24372$ BTU/sec |

In addition the jet contains Latent Heat:

(10.52 Kcal/mol×5 mols)(1800)/10 sec=9468 BTU/sec

The conversion factor 1800 Kcal/(g-mol)(°K) to BUT/(LB-mol(°R)

Secondary In-Flow

The secondary in-flow is extremely complex because it is made up of solids, liquids and gases, combustibles and non-combustibles. A discrete analysis comparable to that of mixed out-flow or Jet in-flow is not possible. However, as those two energy relations are reasonably accurate, as presented, then the energy magnitude of the secondary in-flow as a lumped parameter, is reliably approximated by difference. Therefore

[Total Energy]$_s$=42,120 BTU/sec−24,372 BTU/sec=17,748 BTU/sec

Since it is an objective of the invention to introduce secondary flows at negligible velocities (with the exception in some embodiments where the oxidant is introduced at higher velocities to boost the pumping), the analysis is biased toward the jet energy for providing all momentum transfer. So, any boost in Kinetic energy due to sequent combustion in the accommodation zone makes for a safe side analysis.

Momentum Transfer

An essential parameter in the foregoing energy relations is the velocity term, $V_m$=1275 fps, of the mixed flow taken at the completion of the reaction (stoichiometrically) given as the Main Equation. This velocity has estimated by the simultaneous solution of the:

1. Continuity Equation $G_m=(\rho VA)_m$
2. Equation of State $\rho_m=(P/RT)_m$
3. Momentum Equation, given later These equations are to be satisfied at stoichiometric station m. by trial for a fixed area that diverges the flow from the last secondary in-flow position. Accordingly, the flow here is considered to diverge from a 16 inch diamater to a 20 inch diameter area.

First, a pressure is assumed and the density, $\rho_m$, is computed from the Equation of State. The fitted pressure was found to be 25 psia (3600 psf). Therefore $\rho_m$=3600/70×2340=0.0219pcf Second, the velocity, 1275 fps, which also fitted the Momentum Equation is shown to fit from the Continuity Equation:

$V_m$=(60.84 LBS/sec)/(0.0219 pcf)×($\pi$/4)(20/12)$^2$=1275 fps

Finally, the Momentum Equation, accounts for the transfer of momentum from the jet or primary flow to the auxiliary or secondary in-flow which comprises coal slurry, oxygen, and turbine exhaust established by the Main Equation. Where the jet and secondary flows come together is the accommodation zone. It is recalled, that this zone is taken in this case to operate at just below atmospheric pressure; however, for simplicity, 14.7 psia (2117 psf) is used in the computations. The zone is just sequent to the jet discharge and its standing shock wave; and the area is taken at the 16 inch diameter cross-section. A velocity of 650 fps was assigned to the secondary flows in the accommodation zone representing mainly the oxygen and turbine exhaust velocities, but assuming the coal slurry nominally at this velocity.

| Momentum Equation: |
|---|
| $(GV)_m + g(AP)_m = (GV)_j + (GV)_s + g_o(AP)_a$ |
| $60.8\ V_m + 32.2(2.18)(3600) = 17.8(2918\ \text{fps}) + 43.2(650) + 32.2\left(\frac{\pi}{2}\right)\left(\frac{16}{12}\right)^2(2117)$ |
| $60.8\ V_m + 252.706 = 51940 = 28080 = 95180$ |
| $V_m = \frac{77500}{60.8} = 1275$ fps |

Accordingly, the simultaneous solution is satisfied inasmuch as the practical operation of the gasifier will involve a range of flows, a solution based on a single set of parameters serves mainly to establish feasibility in meeting the objectives, as well as to formulate a guide for practical designs. For example, if the area of the duct at the stoichiometric limit is increased, based on the same Main Equation, and the same total mass flow, then the velocity $V_m$, will decrease and the static pressure, $P_m$ will increase again to satisfy the simultaneous integrity of the equations of Continuity, State, Momentum and Energy. Because of the chemical and physical complexity of the flows coming together in the accommodation zone, specific operating characteristics are of course determined by pilot scale operations.

A salient feature of this invention is the molding of all energies within a single gasifying process in a cascade to effect a cold gas conversion efficiency that is practically indistinguishable from the overall energy efficiency effectively over 85%. In other words, the by-product waste heat fraction would accordingly be less than 15%. The numerical example is extended to demonstrate this in the computations which follow in the next numerical example.

A special feature of this invention is the generation of steam by injecting water directly into the combustors. Because the steam ultimately reacts with carbon to form the carbon monoxide and hydrogen products, it must be made up and this make-up by this invention is the dirty quench water introduced to set the desired chemical reaction at station m and an additional quench amount further down stream introduced toward producing a cold gas (this is, when producing a cold gas is the discharge option).

Because the handling of dirty process water is a serious problem, this invention avoids this by providing no more dirty quench water than is required for direct steam generation within the combustors plus the quantity needed for slurrying the coal secondarily fed into the jet pump.

In exercising the option to deliver a cold gas, further cooling is needed than provided by the said mentioned quench water. This additional cooling is effected by indirect heat transfer means. The methods for applying these means are presented in greater detail in the next example on hydrogen production.

In general, practically all of the downstream heat is recovered and returned to the process except the latent heat of the downstream steam derived from the quench water which must be finally condensed to become the recycled dirty process water. This latent heat is extracted indirectly at low temperature in a condenser, and represents the theoretical limit (except for radiation losses) of energy which cannot be recovered in the process. The clean warm water from the condenser may be used outside the process.

Referring back to the Main Equation 10, moles of water are fed into this process, which represent $10\times10.52$ kcal/mol or 105.2 kcal of latent heat which must leave the process. This represents approximately $6\frac{1}{2}$% of the total fuel energy supplied.

In summary then, the entire process may be regarded as a control volume with an extraordinary combination of controlled feeds to conserve matter and energy approaching 93% efficiency, theoretically, except for radiation losses and minimal external energy required to pump in water for direct steam generation and coal slurry preparation.

However, a large portion of said latent heat need not leave the process in another embodiment whereby steam, instead of water, is fed into the combustors. This steam would be supplied by a steam generator receiving heat indirectly from the products gas stream at some point downstream of station m. The generator would supply this steam to the combustors at system pressure. As this mode limits the flexibility for recycling process water, the prior mode is the preferred embodiment. The elimination of a downstream steam generator also makes for a simpler process.

The next step is an examination of the process efficiency at station m.

Efficiency at Station m

This conversion efficiency is computed on the basis of the fuel value of the carbon monoxide and hydrogen at station m, compared with the fuel value of the carbon supplied. The moles of each are taken from the Main Equation. The values in parenthesis are heats of combustion in kcal/g-mol.

$$\text{Fuel in: Carbon } 16.6(96.6) = 1603.56$$

$$\text{Fuel out: CO } 10(67.63) = 676.30$$

$$H_2O\ 10(68.32) = \underline{683.20}$$

$$\text{Fuel out total: } 1359.50$$

$$\text{Cold gas Efficiency } E = \frac{1359.50}{1603.56} \times 100 = 85\%$$

This is not only the fuel conversion efficiency, but uniquely the overall efficiency as well; because by the practice of this invention, all of the kinetic and flow energy developed by the turbine and boosted in the high temperature combustor CJ have converted to heat and chemical energy. That is, except for the remanent kinetic energy (in the product stream at station m) which is anyway not lost but available downstream for the following related objectives as a driving force toward producing a cold gas:

1. To recover a large portion of the energy from $CO_2$ and $H_2O$ fractions of hot stream represented by the remaining 15% by:
   (a) Intensive indirect heat transfer to preheat the oxygen.
   (b) compressing oxygen by expanding product stream in a turbo-compressor.
2. To separate ash inertially
3. To separate $CO_2$ inertially (by pressure diffusion)

The combustor CJ pressure of 3.2 atmospheres chosen for this analysis (which is boosted by sequent combustion in the jet pump) may according to the foregoing explanations of efficiency be considered to effect an overall efficiency approaching 90%. However, the starting pressure of 3.2 atmospheres is exemplary and not limiting. It's design value is raised as necessary to more than match the total down stream resistance. The safe side excess pressure is anyway throttled to effect beneficial turbulence which enhances heat transfer and chemical reactivity.

This same balance of pressure versus resistance is, of course, effected by a relatively lower pressure in those applications of the invention whereby a hot fuel gas can be used directly; to fire a power plant turbine or boiler, for example. Hot gas applications are also more efficient.

A NUMERICAL EXAMPLE FOR HYDROGEN PRODUCTION

Processes in general are related to the equilibrium constant K and a fixed reaction temperature. Instead by this invention the reaction temperature is changing continuously downward as the coal or carbon particle accelerates downstream. This is because the reaction is taking place on the surface of the particle; and so long as the slip between the particle and the gas stream is significant, or the stream turbulence is intense, then the particle surface for practical purposes is considered to be at the temperature of the gas stream which is of course continually diminishing in temperature because the source of the heat which is the hot jet is giving up its heat to satisfy the endorthermic water gas reaction. The carbon dioxide in the jet is also delivering its share of heat. In every instant along its path the process is driving to a steadily diminishing equilibrium temperature.

FIG. 3-A represents standard equilibrium curves over a range of temperatures for the water gas reaction:

$$CO+H_2O=CO+H_2$$

and the shift reaction:

$$CO+H_2O=CO_2+H_2$$

Accordingly, the log of the equilibrium constant, K, to the base 10 is plotted versus the equilibrium temperature in degrees Kelvin. Curve values above the zero log K line denote that the reaction is being driven to the right toward equilibrium. However, the reaction can continue to the right even below the zero log K line (but with more restraint) providing the stoichiometric inputs and the thermal limits are organized to begin with by the Main Equation to culminate at a lower temperature stoichiometrically at station m.

What has been said so far also applied to any process by this invention for the first or only combustion-jet-pump reaction as in the previous numerical example. However, an added advantage is introduced in this mode of the invention whereby steam is introduced near the point in the process with the Carbon monoxide of the completed or quasi completed water-gas reaction already on stream. Steam may be introduced at this point by any means but the preferred embodiment is to supply at least part of it from the turbine exhaust, as shown in FIG. 3. A further advantage in this mode is the preference to recycle enough hydrogen from the product stream to fire in combustor CJ and in the gas turbine combustor. Accordingly, the only carbon entering the process is the requirement for the water-gas reaction and the matching shift reaction. The expression, Main Equation will be replaced, henceforth, by separate expressions to avoid confusing hydrogen fuel and hydrogen product.

Combustion Reaction:

$$[1.5H_2 + 2.25O_2 + 2\,H_2O_{(1)}]_{298^\circ K.} \rightarrow \underset{[3.5H_2O_{(g)} + 1.5O_2]_{1700^\circ K.}}{\text{JET}}$$

Water-gas Reaction:

$$\underset{[3.5H_2O_{(g)} + 1.5O_2]_{1700^\circ K.}}{\text{JET}} +$$

$$\underset{[6.25C + 1.5H_2O_{(1)}]_{298^\circ K.}}{\text{CARBON SLURRY}} \rightarrow \underset{[5H_2 + 5CO + 1.25CO_2]_{700^\circ K.}}{\text{WATER GAS}}$$

Sequent Shift Reaction:

$$\underset{[5H_2 + 5CO + 1.3CO_2]_{700^\circ K.}}{\text{2nd JET}} +$$

$$\underset{[1.1H_2 + .55O_2 + 3.9H_2O_{(1)} \rightarrow 5H_2O_g]_{800^\circ K.}}{\text{TURBINE EXHAUST}} +$$

$$[3H_2O_{(1)}]_{298^\circ K.} \rightarrow \underset{[10H_2 + 6.3CO_2 + 2H_2O_{(g)}]_{700^\circ K.}}{\text{HYDROGEN PRODUCT}}$$

Referring to FIG. 3, which represents the preferred embodiment for producing hydrogen, the water-gas reaction starts to take place at the first jet pump. The product gas from this reaction diverges to build-up the static pressure above the critical pressure ratio with respect to the sequent jet pump in order to effect a sonic velocity in the throat of the converging-diverging nozzle as shown in FIG. 4. When the critical pressure ratio is not exceeded, the jet-velocity is sub-sonic and the process would proceed, of course, but with a lesser mixing intensity and without the Kinetic benefit of a standing shock wave. Gas-dynamic and fluid dynamic computations are not presented for this case because they are similar to those given previously for producing synthesis gases.

The thermo chemical relations, however, are presented as a base for further demonstrating the high energy and conversion efficiencies intrinsic to this invention as well as the invention's characteristic to recylce dirty quench water. The stoichiometric limit, m, in this case, is taken down stream of the sequent jet pump and comprises the net effect of the foregoing three reactions.

The Consolidated Equation:

$$[2.6H_2 + 2.75O_2 + 6.25C + 10.4H_2O_{(1)}]_{298^\circ K.} \rightarrow$$

$$[10H_2 + 6.25CO_2 + 3H_2O_{(g)}]_{700^\circ K.} +$$

$$6.25(2.6) - 10.4(68.3) \rightarrow -6.25(94) - 3(57.8) +$$

$$16.25 - 710.32 \rightarrow -587.5 - 173.4$$

$$\therefore AH \rightarrow -66.8 \text{ Kcal}$$

Reaction End Temperature: Try 400° C.

$$H_2\ 10(6.98) = 69.80 \qquad T_m = \frac{66800 \text{ g-cal}}{160.41 \text{ g-cal}}$$

$$CO_2\ 6.25(10.46) = 65.38 \qquad = 416^\circ \text{ C. (close check)}$$

$$H_2O_{(g)}\ 3(8.41) = \underline{25.23}$$

$$160.41 \text{ g-cal/°C.}$$

Therefore $T_m$ is approximately 700° K. or 1260° R.

Reactions Discussed

The combustion reactions relating to the first jet and the turbine exhaust can be controlled to go as written. The subscript temperature for the turbine exhaust is the combustor temperature before turbine expansion. This is for simplicity. All kinetic energy ($MV^2/2g$) and flow energy (Pv) functions convert to heat anyway and remain in the process for later use and further conversion.

The completion of the water-gas reaction before the sequent jet pump is problematical, as quasi completion takes place while the system dynamics is driving to compete the compatible shift reaction.

The completion of the shift reaction will depend on the dwell time and the enhanced chemical reactivity due to extraordinarily large incipient slips effected between the reactants in the jet pump and the extraordinarily large turbulence due to large velocities downstream as the slip between reactants becomes negligible. These parameters may, of course, be determined by pilot scale operations.

The reactions given in this case are bench-marks to demonstrate the great potential of the invention for high efficiency and material conservation as stated previously, not the least of which is the flexibility of the gas-turbine/combustion jet pump combination for adjusting reactants, temperature and chemical kinetics to produce these advantages.

It will be evident to those versed in the respective arts, for example, from the foregoing equations:

1. That carbon can be introduced into the combustor, CJ, in place of the fuel hydrogen in order to increase the hydrogen yield of the process.

2. That the subscript temperature for the water-gas reaction can be raised in keeping with more probable thermodynamic equilibrium conditions (see FIG. 3A) by increasing the heat supplied by combustor CJ and/or adding more carbon and oxygen secondarily into the jet pump.

3. The 3 moles of water shown as the last term on the reactant side of the shift reaction are injected into tubes 74a of the sequent jet pump for the direct generation of steam. This is to bring the thermal balance of the shift reaction into the more favorable range of equilibrium with respect to FIG. 3A.

This can be more or less to balance out the supply from the turbine and the capability of first jet pump to deliver more steam with water gas products.

Gas Turbine/Combustion Jet Pump Complex Discussed

Another exceptional characteristic of the invention is to generate steam in significant quantities, by modulating the combustion reactions with water. Thus, by operating the turbine with fairly low inlet temperatures, directly generated steam becomes the principal driving fluid of the gas turbine. The main requirement for the gas turbine is to deliver adequate flows and pressures to the combustor CJ. The flexibility for doing this, for various flows through the turbine, is the capability of the turbine to deliver its exhaust over a range of back pressures whereby the related expansion ratios of the turbine are less than the required pressure ratio of the compressor. All flows are, of course, controlled down by throttling. A throttled back pressure at the turbine exhaust, therefore, permits a range of steam for process requirements at a given compressor delivery.

The kinetic and flow energies down graded in this way are not wasted by this invention because they convert thereby to turbulence and heat which are anyway needed in the next reaction. In short the system is designed so that the steam expanded through the turbine can deliver more oxygen through the compressor than required; but by operating the turbine at a suitable back pressure, the oxyben requirement is met. This conrol is further modulated by designing to fire the turbine combustor over a suitable temperature range. In this way, a wide range of steam flows can be effected through the turbine for fairly fixed flows from the compressor.

The foregoing flexibilities inherent to this invention facilitate the use of standard and quasi-standard turbo-super-chargers which are considerably more economical to buy than conventional gas turbines. However, gas turbines or other engine driven compressors may be similarly applied and are preferred when multistage compression is required.

| Efficiency Accounting at Station m | | | | | |
|---|---|---|---|---|---|
| Fuel in: | Carbon | (6.25) | (96.6) | = | 603.75 |
| | Hydrogen | (2.6) | (68.3) | = | 177.58 |
| | | | | | 781.33 Kcal |
| Fuel out: | Hydrogen | (10) | (68.3) | = | 683 Kcal |
| Tentative efficiency (cold gas basis): | | | | | |

-continued

| Efficiency Accounting at Station m |
|---|
| $E_t = \frac{683}{781.3} \times 100 = 87.4\%$ |

The difference between the cold gas values, in and out, is 98.3 Kcal. By subtracting the latent heat content of 3 mols, of steam:

$$\Delta H = -98.3 + (3 \times 105) = -66.8 \text{ Kcal}$$

The difference is the sensible heat in the products stream at the stoichiometric limit.

This checks the previous computation of −66.8 from the consolidated equation.

The sensible heat therefore at this point represents only 9% of the input fuel energy. In the embodiment for a cold gas it is preferred to drop the temperature of the products stream below 100° C. at least.

The objective toward this end is to preclude condensing more process water than is required for recycle and make up. As 7.4 mols of make up water are required by this stoichiometry at least 4.4 additional mols of water are introduced downstream of station m.

In summary, 14.8 mols of water flow into the system whereby 7.4 convert and the remaining 7.4 become steam to later be condensed out for recycle by indirect heat exchange. The product stream temperature is therefore determined by mixing in 4.4 mols of water:

| | | | |
|---|---|---|---|
| Stream ΔH at station m | | | −66.83 |
| 4.4 (10.5 Kcal/mol) | | | 45.85 |
| Sensible Heat Remaining | | | 20.98 Kcal |
| Mixing End Temperature: 100° C. by Trial | | | |
| $H_2$ | 10(6.924) = | 49.24 | |
| $CO_2$ | 6.25(9.25) = | 57.8 | $t = \frac{20980 \text{ cal}}{185.84} = 112°$ (closecheck) |
| $H_2O$ | 7.4(8.08) = | 59.79 | |
| | | 186.84 | |

Depending on the downstream resistance, the pressure at this point in the flow can be predicted by design. Assuming 1.5 atmospheres, for example, the corresponding saturation temperature is 110° C. Therefore, 7.4 mols of fresh make-up water may be considered to discharge from the condensor at about 100° C. and added to the 7.4 of process condensate to be introduced into the process as earlier described. For simplicity, the heat returned to the system is represented as sensible heat in water raised from 25° C. to 100° C. approximately. This represents $$q_{water} = Wcp\Delta t = 14.8 \text{ mols} \times 18 \text{ g-cal/(mol)(°C.)} \times 75\text{C.°}$$

$$q_{water} = 19980 \text{ g-cal or approx. } 20 \text{ Kcal}$$

Since the consolidated equation is balanced out at 25° C. or 298° K., the heat returnable by this continued analysis is considered to reduce the fuel previously assigned in the consolidated equation by an equivalent heat quantity.

Downstream sensible heat is additionally extracted to preheat the hydrogen and oxygen after compression. This heat operates to further reduce the previously assigned fuel quantity. An estimate of this preheat will follow shortly.

These heat returns are treated in retrospect to simplify in part an already involved starting analysis and to establish the related magnitude of these recoveries, but mainly to demonstrate that the basic efficiency is already high before recovery.

Preheating Hydrogen and Oxygen

At the compression ratio of 3.2 hydrogen and oxygen are delivered from the compressor at approximately 140° C. Therefore, preheating would take place indirectly after compression to a level of about 360° C. The hydrogen and oxygen taken together are 5.4 mols and a nominal means molal heat capacity of 7 g-cal/(g-mol)(°C) can be applied in this temperature range. Accordingly, this preheat estimate is:

$$q = M\, c_p\, \Delta t = 5.4(7)(360°\text{ C.} - 140°\text{ C.}) = 8316 \text{ g-cal or } 8.3 \text{ Kcal}$$

As this heat would be applied to the system to replace a fraction of the fuel reacted in the consolidated equation, the net heat at station m, $\Delta H = -66.8$ is considered to hold with little error. This also applies when the fuel fraction replaced is increased due to increasing the water feed from 25° C. to 100° C. as previously described. The heat added to the above preheat gives 28.3 Kcal. The net effect of this recovery on the efficiencies follows:

| Efficiency Adjusted For Recovery |
|---|
| Fuel in 781.3 − 28.3 = 753 Kcal |
| Fuel out (as above) = 683 |
| $E_{net} = \frac{683}{753} \times 100 = 90.7\%$ |
| Estimate of net hydrogen fuel supplied: |
| Hydrogen Fuel − (177.6 − 28.3)/68.3 = 2.2 mols |
| Net Hydrogen Produced: |
| Hydrogen Product 10 − 2.2 = 7.8 mols |

However, the hydrogen fuel (1.1) thereby alotted to combustor CJ may readily be replaced with carbon in equivalent heat content to increase the hydrogen product yield to 8.9 mols.

Except for the method of recycling process water previously presented and the thermal assist option to inertial separation of the light from the heavy gases to be elaborated later, the heat recovery means necessary for achieving the foregoing objectives may be typical of the art of heat transfer. For example, one way to preheat the oxygen and hydrogen, after compression, is to route them through cooling jackets around the combustion shells and jet pump reactor before firing them.

The Inertial Separation of Light Gases-Principally Hydrogen

The example for hydrogen production is explicitly from processing carbon or char. However, it was stated earlier that coal could be substituted yielding ash which must be separated and volatiles adding fuel value to the product. Coal also can involve impurities such as sulfur oxides which are to be eliminated later by conventional clean-up procedures.

The process in FIG. 3 is extended to show two cyclones 70 and 70*a*. Cyclone 70 is shown to separate ash through lock hopper 18. Therefore, it applies to processing coal or char. Cyclone 70*a* is for a second stage effect and is optional. Cyclone 70*a* is set to begin with, to receive mainly gases and water vapor and traces of fly ash. The flow velocity of the mixture entering either cyclone is extraordinarily high compared to the practice with conventional cyclones. The peripheral velocity inside increases, due to the conservation of angular momentum, to a maximum value at the point of minimum radius. Accordingly, to insure continuous flow, the peripheral velocity at this point cannot exceed the velocity of sound. At any given temperature, this is higher, the lighter the gas. For $CO_2$ at 500° K., the sonic velocity is 1118 fps. The practice by this invention for separating gases is to design to approximately 1000 fps at this point with respect to cyclone 70. As any $CO_2$ rising with the hydrogen is expected to be a relatively small quantity the critical sonic velocity of cyclone 70*a* is expected to be well over 2000 fps. This sets its design criterion.

Because of the higher circulation velocities permissible in cyclone 70*a*, all or part of the final quench water (programmed after Station m) may be introduced as a mist inside trained on the outer periphery of the flow. By a further option, heat may be extracted by a cooling jacket externally fixed to the cyclone shell. These applications of heat transfer increase the thermal gradient in the fluid to enhance the centrifugal pressure gradient which effects the separation of matter according to particle density.

Returning again to FIG. 3, the top and bottom exit gas tubes in cyclone 70 and the top exit tube of cyclone 70*a* are adjustable in the vertical direction in order to optimize the separation. The down-gas discharges from both cyclones (which include water vapor) may be joined as shown by dash lines to proceed for further processing. The water vapor will pass through a condenser (not shown) into a gas/liquid separator. The liquid or condensate is the process water which is returned to the system as earlier described. The waste gases, mainly $CO_2$, may be further treated by any conventional means for recovery and pollution control.

FUEL RECLAMATION

The invention also provides for the extraction of a fuel in a usable state from a polluted mixture. A typical mixture is oil soaked matter resulting from the retrieval of oil slicks. The retrival medium may be burnable such as straw, for example, or it may be an absorbing non-combustible mineral. In the latter case, the non-combustibles are inertially separated. The mixture initially is pumpable in much the same way as sewage sludge depicted in FIG. 1. However, to facilitate extracting the fuel in an acceptable state, an independent branch line is used or a separate plant is established for this purpose. The method involves a turbine powered combustion jet pump. The jet pump configuration of FIG. 4 is suitable except that oxygen scroll 71 is precluded. The oil saturated matter is ingested through or pumped through ports 74. The action of the high pressure jet is pyrolitic. Its function is simply to evaporate the oil which would be separated by a cyclone or other inertial means along with other gases while all the solid matter would be retrieved from the cyclone for further incineration. Alternately, if the fuel value is needed, insitu, as in the case of sewage sludge in FIG. 1, then a separate branch line is not needed and it would be introduced in the same way as the sewage sludge and incinerated.

FUEL GASTIFICATON SUMMARY AND FURTHER MODES

As demonstrated, the combustion jet pump and its method of operation is broadly applicable to the combustion of regular fuels and waste matter and is equally effective for rapid heat and mass transfer in chemical reactions in general. This versatility of method and apparatus was shown to be ideally suited to fuel gasification. The speed of reactions accordingly afford relatively small equipment for large production rates. Though very high process pressures are not precluded, many fuel gasification processes, by this invention, operate in the range of 2 to 6 atmospheres absolute for chamber CJ. These include coal devolatilization and hydrogenation
synthesis gas production
low and medium BTU gas production which may be procuced by relatively simple gas-turbine powered combuston-jet pumps as shown in FIGS. 2 and 3. This apparatus is so compact as to be portable when necessary. For example, it may be located in and moved around in a coal mine. It is well known that in some coal mining operations, the coal is ground in underground cells and moved out by conveyors. Instead, by this invention, the ground coal is gasified locally in the cells and pumped out by the available energy residing in the flow.

The gasification method earlier described which functions without oxygen is partly portable. The gas turbine heated steam generator is located at the mine head, and the steam is piped to one or more locations in the cells where the steam powered jet pump is ingesting and gasifying coal slurry and pumping the product gas to the mine head for further processing. The ash content may be cyclone deposited in each cell location in the mine or at the mine head.

Other gas clean-up and purification steps are applied by known means after the inertial separation of the ash content. This is the case for all gasification modes in this invention except that in special operations solvent refined coal may be fed to the jet pumps gasifier which of course precludes or minimizes clean up after gasification. There is always the need in the production of high BTU gas constituents and synthesis gases to remove the $CO_2$ and excess steam and these also, will be removed by known means.

While the method of generating high slip velocities between reactants, as earlier described, is preferred for heat and mass transfer and kinetic reactivity, the practice of melding at least most of the available energy into the flow as it converts to heat for the endothermic requirement also affords an intense mixing action for heat and mass transfer simply by tailoring the energy in a maximal way to dissipate in transit and of course allowing enough kinetic and flow energy for down stream processing.

The melding of energy and products in this way optimizes the fuel value of the reactants and accordingly of the product gas, and thereby further makes for high cold gas efficiencies.

To stablilize or set a chemical reaction to yield the desired products, it is usually necessary to quench the product gas stream at a suitable time and temperature. Otherwise, a slower cooling down by classical heat exchanges allows the reaction to change or proceed to a less desirable end point. This is avoided in most practices by quenching the gases directly with water which converts to steam and needs to be removed ultimately by condensation. The latent heat degenerated in this way of course detracts from the process efficiency.

Alternately, this invention allows enough flow and kinetic energy to effect intense indirect heat exchange at this point. Water is pumped into the heat exchanger at a suitable pressure and converted to steam which is returned to the system to fluidize coal particles or to augment and cool the combustion products in chamber CJ. An additional indirect quenching medium is the oxidant which becomes preheated for combustion in the jet pump.

By a further step, excess flow energy is extracted with a turbocompressor which super charges the oxidant before its entry into the system.

Therefore, more or less cooling is provided depending on the sequent utilization of the fuel gas. When a cold gas is required, however, the ultimate cooling step is effected by a direct water quench. The resulting dirty water is then removed by any appropriate liquid-gas separator, and thereby becomes available as make-up for slurry feed and direct steam generation through secondary entry into a jet pump; or pumped in at system pressure to temperature-modulate the combustor reactions.

Accordingly, the melding of energies and the regenerating of heat within the system yields a low temperature product gas for cleanup and purification that not only has a cold gas efficiency of approximately 90%, but its heat utilization efficiency is also approximately 90%. In a manner of speaking the system is a black box that receives energy and matter and converts it and delivers it as fuel with enough energy for further processing so that losses by any yardstick are of the order of 10%.

The design of sequent jet pumps for near sonic velocities and particle acceleration will be clear from the present disclosure to those having sophisticated knowledge of gas dynamics and fluid flow which are within the skill of those versed in the art. It is important in this practice that significant flow ranges are accommodated. Jet nozzles 73 of fixed diameter, as earlier described, allow for this up to a point by increasing the back pressure or driving pressure in chamber CJ while still maintaining a negative pressure just downstream of the nozzle for ingesting secondary flows. The range may be increased further by pumping in secondary flows. However, the range is extended still further and differently with a jet pump of another design whereby the throat opening at the jet is adjustable. This design is discussed later as FIG. 5.

So far the combustion jet pumps and the non-combustion jet pump are dissipative in the transfer of energy between different flows. Energy dissipation is generally desirable to enhance chemical reactions especially when the heat generated in this way is applied as the endothermic requirement which is practiced by this invention in fuel gasificaton. On the other hand, less dissipative pumping means are preferred as booster pumps. These are discussed as jet pump design features which follow.

JET PUMP DESIGN FEATURES

When large quantities of fluid are to be handled by the jet pump, entrainment is enhanced, when the power stream is supplied through a cluster of nozzles uniformly distributed in the cross-section of the secondary flow. However, the manifold and the nozzle cluster is difficult to achieve in a combustion zone or in a high temperature system. Instead, this invention in the preferred embodiments, utilizes power and secondary streams of annular cross-section.

Figure 5:
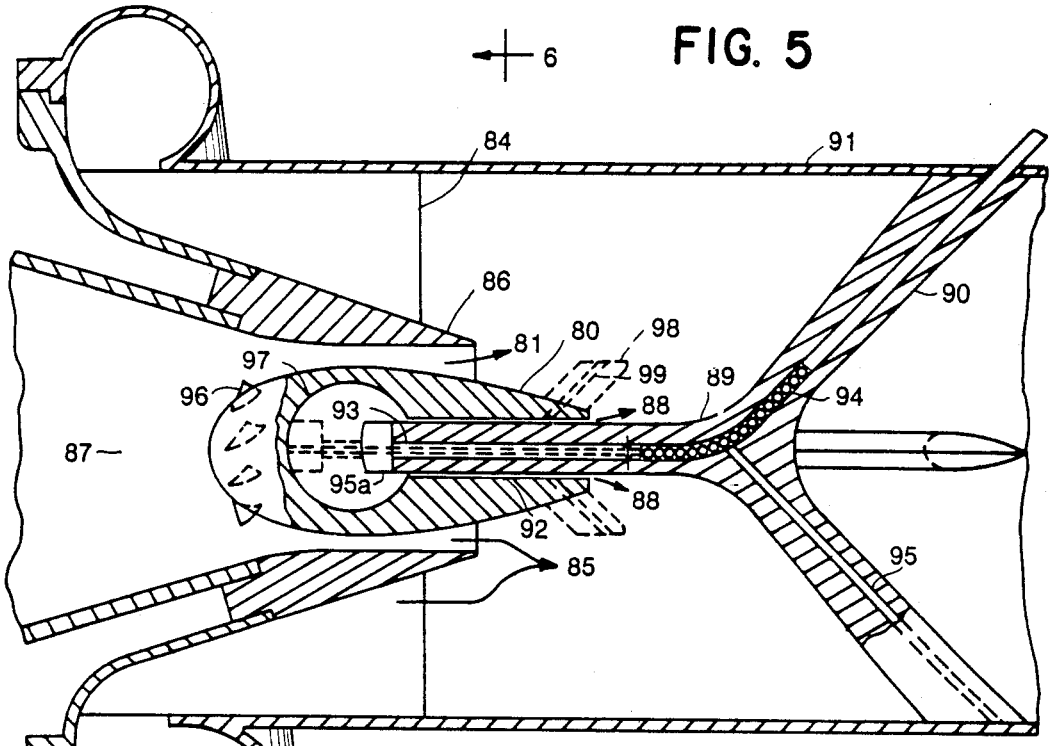
FIG. 5 is a cross-section on the centerline of an annular jet pump showing a rotating teardrop and fixed support struts.

Cooperating with the circular construction in FIG. 5, a teardrop-like structure 80 in line, concentric and opposite to the flow direction, constitutes the inner surface of the inner annulus. The inner annulus is defined by the primary jet discharge 81. The secondary flow is preferably introduced at right angles 82 to the line of flow of the primary jet by a scroll or doughnut-shaped passage 83, of diminishing cross-section with guide vanes 84, turning the flow so that it is in line with or intentionally skewed as it merges with the primary jet to form the joint low pressure flow 85. The skew is to promote mixing at the possible expense of flow and kinetic energy transfer to the secondary stream, although mixing is indigenous to said transfer. The gas dynamics at the junction 85 is complex. The primary jet flow in most instances will be designed for supersonic expansion. As a flow range is generally the practical requirement, mild shock waves will occur without serious effects. However, the flow range may be increased by providing fore and aft adjustment between nose tube 86 and teardrop 80. The tube 86 is the axial extension of spiral shroud 83 and combustion space 87 which discharges the primary stream. At the junction 85 where it forms the annular diverging nozzle for discharge 81, its internal contour is either cylindrical as shown, or may diverge to further expand the primary stream.

The teardrop-like structure 80, for brevity later referred to as the teardrop, need only resemble it at the extremities for streamline purpose. The intermediate section, as shown in FIG. 5, is naturally contoured to provide the correct expansion in cooperation with its fore and aft adjustment and the nost tube 86. However, the teardrop 80 may be long or short, cylindrical or tapered, depending on its further functions; such as:

1. Extending through the mixing zone
2. Providing an in-line motion adjustable in stiffness by mechanical or separate fluid control: (a) to dampen or incite oxcillations in the primary stream; (b) to adjust and hold primary discharge area.
3. Introducing an additional secondary stream 88 inboard of the primary jet.
4. The combination of functions 3 and 4.

The teardrop support shaft 80 (for simplicity later called the rod) is fixed along the center line by preferably three equally-spaced spokes or struts 90 which attach to duct 91. Duct 91 is the outboard axial extension of spiral shroud 83 which, together with inboard extremity of nose tube 86, comprise the annular nozzle of the main secondary stream. Duct 91 is shown to be cylindrical, but may diverge to further accommodate increases in specific volume due to combustion downstream of joint discharge 85. However, duct extension 91 may converge, if necessary, in the absence of combustion or for accelerating the flow within stable limits for steady flow. The central bore 92 of the teardrop 80 neatly matches, with proper clearance, the mating contour of shaft 89.

As stated, the teardrop 80 may or may not rotate depending on its function. The non-rotating teardrop is described first in conjunction with mechanical fore and aft positioning. The struts 90 and shaft 89 are preferably formed in one piece, cored along the centerline of the shaft 89 and continuing along the centerline of at least one strut as shown, forming one continuous passage for locating rod 93 and ball bearings 94. Any external means not shown may be provided to push the ball bearings (radially inward along strut 90) which in turn push the locating rod 93 and it, in turn, pushes the teardrop 80 to set the proper annular expansion area for the primary discharge 81. The thrust of the primary jet against the nose of the teardrop 80 may be used to fix its position against the locating rod 93. By relaxing the ball bearing pusher means, the thrust relocates the teardrop 80 and, accordingly, changes the nozzle area for discharge 81. The internal passage **95*a* (smaller in cross-section than the ball bearing passage) may be used to lubricate the moving parts. Rod 93 is center-bored for this purpose and provided with an enlarged head 95** to reduce interface bearing load.

Passage 95 may also be used for continuous fluid supply discharging as an additional secondary stream 88 aft of the teardrop 80. This would serve the following functions:

1. Neglecting friction with lubrication, the teardrop 80 can develop torque-free rotation from the primary stream thrust by alternately employing vanes or blades 96 shown in phantom. This would enhance mixing and combustion downstream of junction 85.
2. The fluid entering through passage 95 and discharging as 80 could be water to augment and cool the combustion products through evaporation. Alternately, it could be a combustible liquid pollutant dispersed in fine droplets by the whirling teardrop.
3. The rotation may be alternately lubricated by an air bearing function. For this purpose, the extremity of passage 92 is cored to the balloon contour 97 to serve as plenum for the pressure force differential across the teardrop nose. In any case, air is bled from the high pressure compressor (not shown) or the high pressure space in scroll 83 (and boosted if necessary) to lubricate the whirling teardrop.
4. Alternately, fan blades 98 with cored passages 99 may be added to supplement bleed 88 for discharging fluid according to foregoing items 2 and 3. Besides flinging the fluid with a greater atomizing effect, they operate to centrifugally pump any fluids admitted through struts 90.
5. Either blade alternatives 96 and 98 would provide a beneficial pressure exchange function more fully described with respect to FIGS. 6, 7, and 8.

Figure 6:
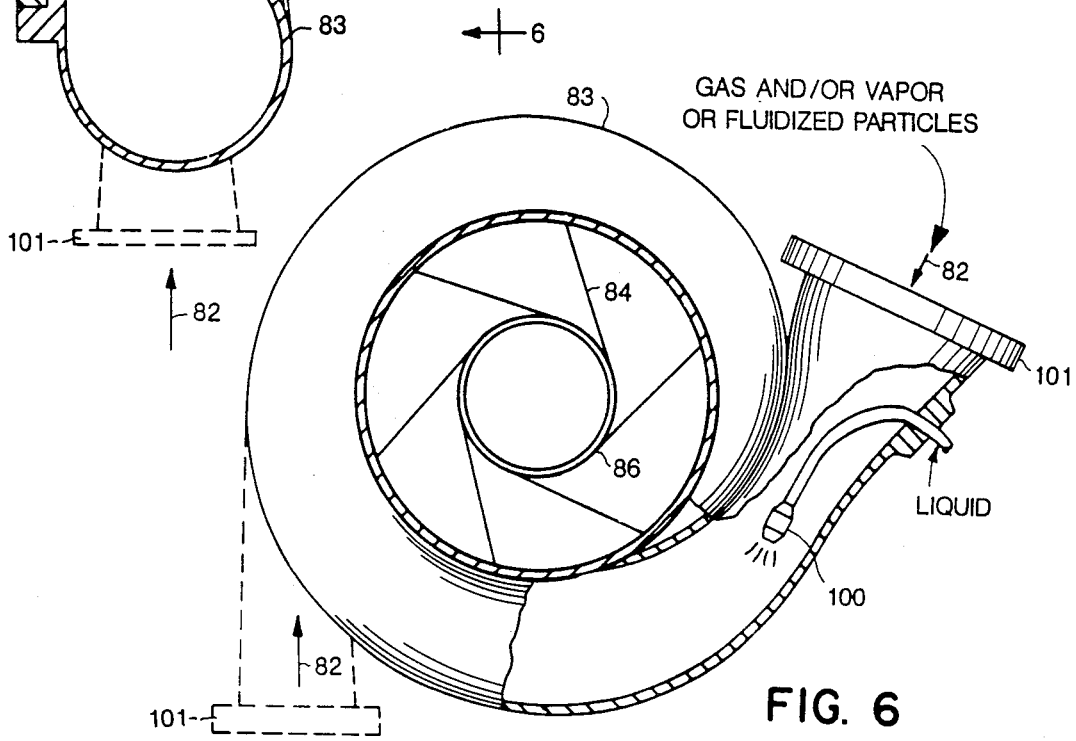
FIG. 6 is a slightly scaled-down section to FIG. 15, showing a spiral manifold with secondary ports to receive secondary pollutants and for oxidants.

Before proceeding with FIG. 6, the characteristics of FIG. 5 embodiments will be reviewed. The primary stream passing through high pressure space 87 may be:

1. Superheated steam
2. Oxidant rich combustion products
3. Fuel rich combustion products
4. Relatively inert combustion and non-combustion products.

In all four cases, the jet pump may operate as a burner by introducing adequate oxidant and/or fuel in the secondary paths. The objective in most cases will be to complete the combustion in the first jet pump. However, with particularly difficult combustible pollutants, at least one sequent combustion jet pump must be provided.

The flame velocities in most cases will exceed the burning velocities. When the shock wave occurs downstream of nozzle 86 portions of the flame at junction 85 will be supersonic. This is similar to the burning conditions of ram jet engines with respect to gas velocities and design temperatures. Heat releases exceeding 40 million BUT/hr-ft$^3$ per atmosphere are attainable.

Though the mean flow of the reactants is unidirectional, the burning reaction itself is multidirectional.

Accordingly, if the combustion reaction zone length is set so that the dwell time substantially exceeds the burning time, complete reaction is assured. Achieving this in relatively short zones provides for the high heat releases. In this invention, the multidirectional combustion reaction is enhanced by:

1. Delivering the primary stream through space 87 at temperatures adequately above the ignition temperatures of the sequent mixtures
2. High difference in velocities between primary and secondary streams effecting high shear stresses
3. Whirling teardrops 80
4. Vortex flow incited by spiral shroud 83 and vanes 84 and, if necessary, by a counter-skew and flame holding effect of struts 90.

FIG. 6 is a scaled down end view and partial section of FIG. 5, and illustrates how there can be more than one secondary port 101 in a single scroll or spiral shroud for adding gaseous or vapor reactants as necessary in a spiral pattern. The spiral manifold or shroud 83 is effective because of the various ways the flows are added for their sequent functions. However, shrouds or scrolls in series, as shown in FIG. 4, are also effective.

Atomizing nozzle 100 delivers any liquid reactant. If the reactant is a sole pullutant or fuel, then port 101 receives the balance of the oxidant supplementing the primary stream for completing combustion. The atomizing nozzle may be any steam, air, or mechanical atomizing nozzle known in the art.

Accordingly, the spiral manifold 83 is the means for receiving reactant matter in any physical state. Of course, solids would have to be decimated by any known method and entrained with gas or vapor, or liquid.

These combustion advantages will also abide in the jet pump of FIGS. 7 through 12 which follow, but they are especially designed to increase the flow and kinetic energy transfer from the primary to the secondary streams for the transport and utilization of the resulting products.

Figure 7:
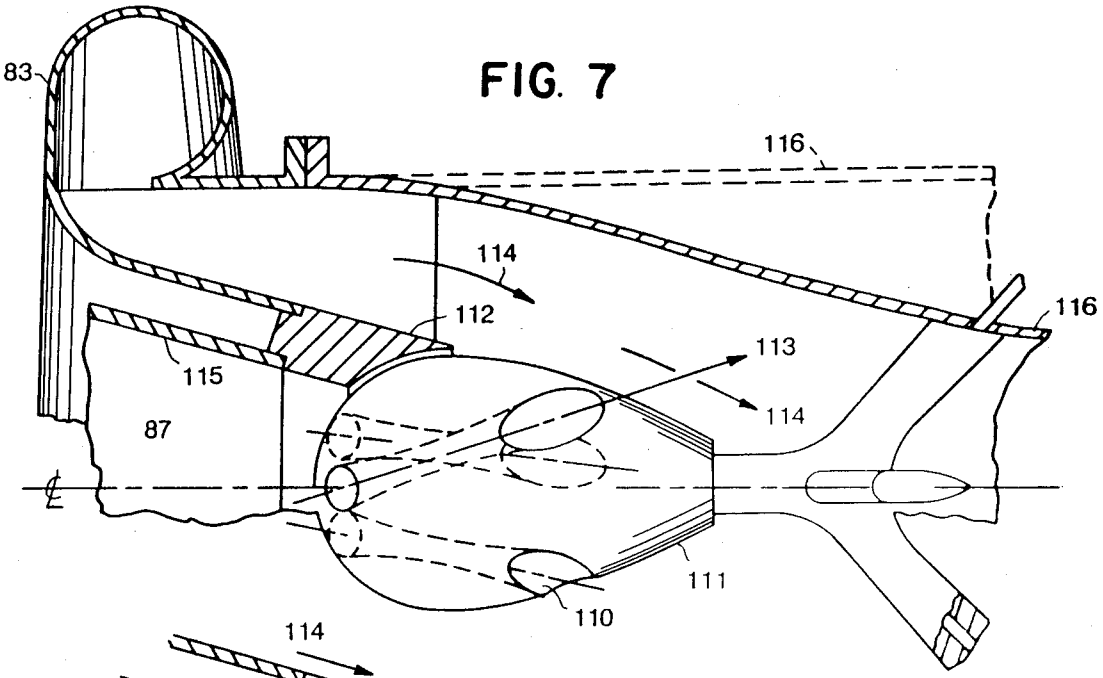
FIG. 7 is a partial side elevation in cross-section of a crypto-steady flow jet pump for optimal flow and kinetic energy recovery.
Figure 9:
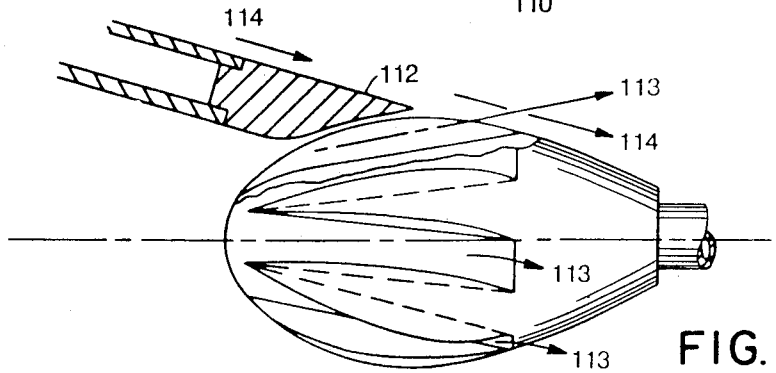
FIG. 9 is a part sectional elevation of another crypto-steady embodiment showing stub axial flow blades serving as rotary jet nozzles.
Figure 8:
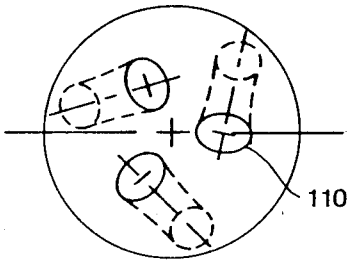
FIG. 8 is an end view of the rotor of FIG. 17, showing skewed nozzles through the rotor body.
Figure 10:
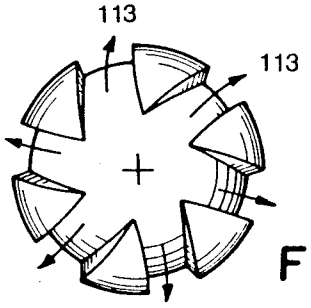
FIG. 10 is an end view of the rotor to FIG. 9.

FIG. 7 shows a special embodiment of the jet pump wherein the primary stream is delivered by three skewed nozzles 110 cored into the teardrop rotor 111. An end view of the rotor, FIG. 8, shows these nozzles with equal angular spacing. The rotor 111 is supported like the teardrop 80 of FIG. 5 and may adopt the same positioning, lubricating, and secondary feed characteristics.

The nozzles 110, in replacing the annular nozzle for primary discharge 81 of FIG. 5, add a distinct new function to the jet pump which can be described as crypto-steady pressure exchange, so called because the method of analyzing the pressure exchange between primary and secondary streams is reversible with respect to steady flow depending on whether the frame of reference for a flow is rotating or stationary. The reversibility analysis with respect to a rotating frame of reference indicates that the flow energy and kinetic energy is transferred from primary to secondary stream without dissipation. In effect, the secondary stream is captured within the pitch spacing of the rotating screw-like paths of the primary streams and is compressed thereby to a much higher pressure than possible with simple jet pumping which depends on the shear force between the stream elements for accelerating the secondary flow and is dissipative. The screw-like path in this embodiment is, of course, generated by the relatively torque-free rotor 111. Note that nose section 112 does not effect the junction of the primary and secondary streams as with nose extension 86 in FIG. 5, but merely allows for minor bleed in the clearance between itself and rotor 111, and separates the rotating jets from the peripheral drag present in the embodiment of FIGS. 9 and 10 where the nose section 112 forms the fixed outboard contour of the rotating jets 113.

Further, since space 87 is generally at high temperature in contrast with the secondary flow 114, the substantial thickness of section 112 permits its fabrication and the fabrication of wall 115 of high temperature materials, whereas the entire shroud 83 could be of low temperature material. Mixing tube extension 116 is shown alternately in phantom to permit larger flow cross-sectional areas to accommodate combustion or deceleration of the combining streams.

Figure 11:
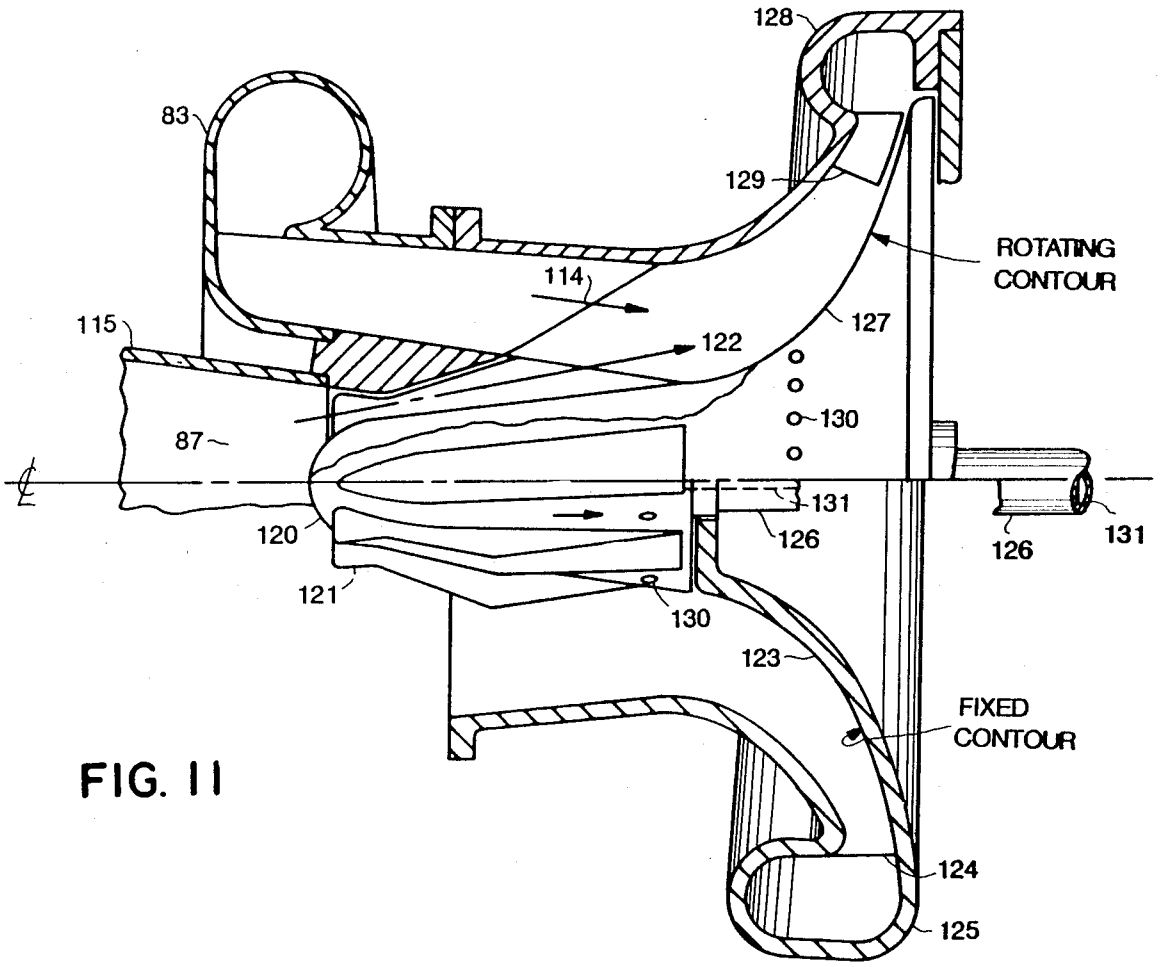
FIG. 11 is a cross-sectional elevation of still another crypto-steady flow jet pump shrouded for radial discharge adapting either a fixed or rotating inboard mixed flow passage.

The embodiment represented by FIG. 11 converts axial to radial flow in the pressure exchange between the primary and secondary streams. Two versions are shown. In one, below the centerline, the torque-free rotor 120 with skewed blades 121 induces the rotating jets 122 which function in the same manner as the rotating jets 113 of FIG. 9. That is to join the exchange pressure with the secondary flow. The flow is then directed toward a radial path by stationary wall 123 and is collected through vanes 124 into spiral shroud 125 in a manner similar but opposite to the delivery of the secondary flow through shroud 83 of FIG. 5. The mixed flow is thus discharged through a port similar to port 101, not shown. The rotor 120 is supported by extended shaft 126 and externally mounted in suitable double bearings, not shown.

The alternative shown above the centerline shows the same rotor 110, but in one piece with the continuing base contour which directs the flow toward radial paths, but at the same time rotating with the jets 122. The base contour terminates at shroud 128 and cooperates with vanes 129 to deliver the combined flows through spiral shroud 128.

The holes 130 connecting with bore 131 may be provided for supplying additional fuel and/or water. Contour 127 is contiguous structurally with rotor 120 and rotates under flow.

Figure 12:
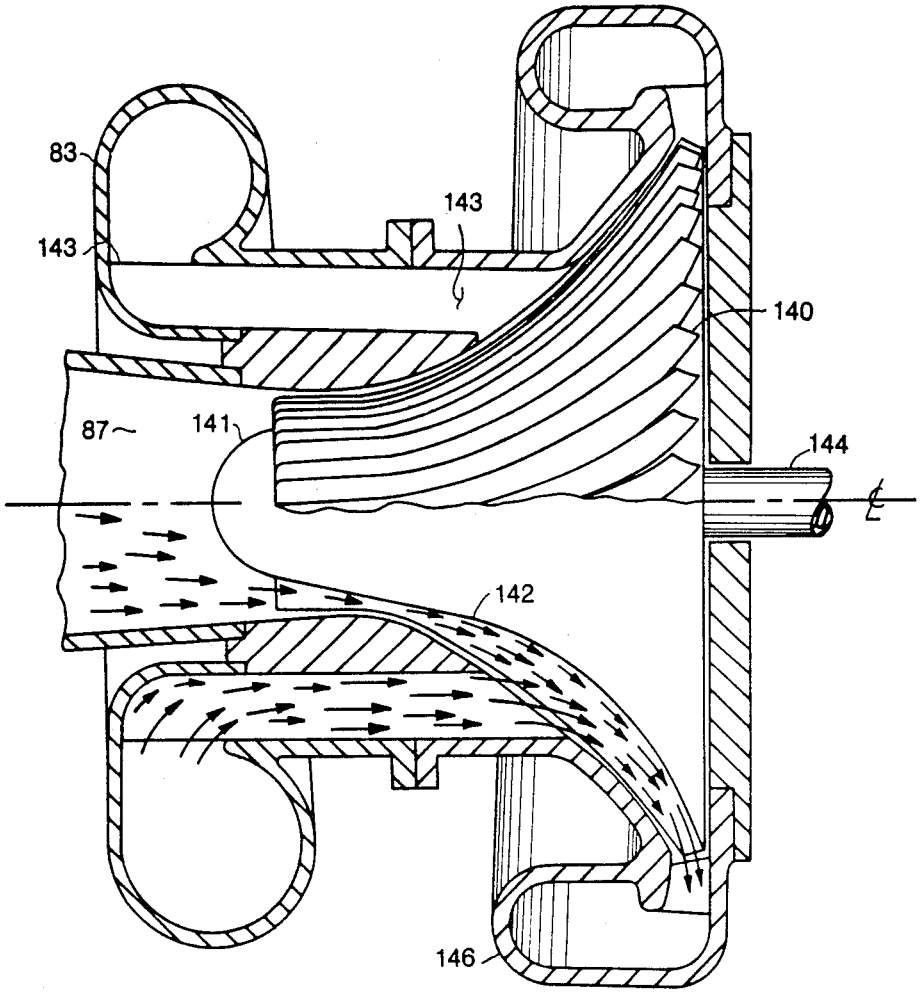
FIG. 12 is a side elevation and part section of a mixed flow, compound function, single runner roto-jet pump.

The embodiment of FIG. 12 is somewhat different from any of the prior jet pump configurations in that it combines the function of a simple jet pump with the functions of a mixed flow turbine and a mixed flow compressor taking place simultaneously (with or without combustion). Its main advantage is increased discharge pressure and/or the transmission of shaft power from the combustion of reactants in a relatively compact assembly. First consider the case without combustion, where no shaft power is transmitted to the outside.

The primary jet is space 87 first acts on blades 140 mounted on torque rotor 141. The blade angle at this point is shallow in the flow direction. The action is that of an axial turbine. As the primary stream moves along the floor 142 of the blade passage, the blade warp is gradually transforming the inboard stream path from the axial to radial flow, and the primary jet thereby produces a mixed-flow turbine action. At the same time, the outboard blade edge is drawing in the partially entrained or jet pumped secondary stream and compressing it in the manner of a mixed-flow compressor. The outboard warp of blades 141 cooperate with the warp of the guide vanes 143 (fixed to the discharge annulus of the shroud 83) so that the transport of the secondary flow from the annulus to the blade passage is a smooth transition. Thus, at the onset of the flows, the blades 140 respond as a turbine to the primary flow and as a compressor to the secondary flow. At the point where both flows are mixed, then the runner operates as a compressor to the point of discharge in simultaneous response to the distributed prior expansion of the primary jet.

If diffused combustion is introduced along the blade path, this increases flow velocity and operates to accelerate mixing and compression. The expansion after combustion, accordingly, is a booster turbine action delivering either more shaft power or exhaust thrust, or both, depending on the loading. Passages would have to be designed to maintain subsonic velocities. Thus, the added energy would be discharged as an increase in flow energy and kinetic energy unless some was taken out as shaft power. For this purpose, the rotor 141 is connected to shaft 144 mounted preferably in outboard bearings not shown. The collected stream discharges through nozzles 145 into discharge spiral manifold 146. If an inline annular exhaust shroud (not shown) is substituted for the spiral manifold 146, and the gases are guided to discharge in the axial direction to the atmosphere, the unit would then function as a thrust augmentor or a jet engine.

Some distinctions must be reviewed with respect to heat energy in the practice of my invention. The principle "heat" of the invention comprises:

1. The available energy from engine expansion
2. Plus heat energy accumulated above the expansion inlet temperature from the higher combustion temperature (after compression) in the jet-pump combustor.
3. Plus any heat added through diffuser and/or jet pump combustion.

Because the low grade heat energy in the expanded exhaust mixture is recoverable in many ways usual in waste heat recovery, the details of such recovery are naturally precluded except when exceptionally utilized as, for example, when the exhaust mixture is ingested at subatmospheric pressure into the jet pump to increase its flow energy for ultimate heat utilization.

By way of summary it can be pointed out that the equipment described herein results in the provision of means and methods for firing fuels and other burnable matter under pressure in any physical state, transferring part of the energy developed in combustion to fire and entrain additional matter in multiphase flow to effect heat and mass transfer for endothermic and exothermic reaction with such intensity as to simultaneously excite the reaction kinetics while retaining substantial kinetic and flow energy in the flow to inertially separate non-combustible solids and for further heat and mass transfer in order to avail practically the entire heat content of all the matter fed into the system in sequential uses, thermally cascaded for ultimate low temperature utilization and wherein the matter on entry to the system is first processed through pressurized combustion to develop most of its available energy potential for its transport properties which energy in a balanced way converts back to heat for domestic and commercial use and in chemical processes where the absorbed heat converts to chemical energy, principally in useable fuels, and finally, whereby the capture of heat and the optimal development of available energy in this balanced and comprehensive way affords the highest feasible process efficiencies.

What is claimed is:

1. Apparatus for jet pumping comprising a primary nozzle coupled to a high temperature-high pressure combustion chamber, constructed for over two atmospheres and to withstand temperatures over 1500° F. at least one secondary supply port substantially tangential to a quasi-doughnut shaped secondary supply housing, the axis of said housing being concentric with and attached to said nozzle, such that the inside diameter of the discharge annulus from said housing conforms in diameter with and attaches to the nozzle at some distance aft of the nozzle discharge extremity, and the outside diameter of said discharge annulus conforms with and attaches to the aft extremity of a cylindrical-to-diverging mixing tube for said jet pumping, said apparatus for jet pumping constructed to withstand combustion temperatures up to stoichiometric levels with said mixing tube discharge area designed for fluids flowing at subsonic velocities, and comprising further a secondary flow path of diminishing cross-section in said supply housing, a plurality of equally spaced radial vanes provided between the outer wall of said nozzle and the inner wall of said mixing tube, the down stream extremities thereof terminating at some point down stream of said discharge annulus, the warp of said vanes shaped for directing centripetal flow in one direction and inclined toward increasing axial flow in the other direction, a teardrop-shaped body located on the center line of and partially inside of said nozzle extremity so as to form a primary annular discharge orifice, the axial cross-section of said orifice conforming the the requirements of up-to-supersonic primary discharge flows, said teardrop being held in place at the down stream extremity by suitable means.

2. Apparatus for jet pumping according to claim 1 wherein said means provide for the for and aft adjustment of said teardrop shaped body so as to change the discharge area of said orifice.

3. Apparatus for jet pumping according to claim 1 wherein said means provides for the free rotation of said teardrop and the axial cross-section of said orifice is extended lengthwise and is reduced to mere clearance to redirect the primary flow through at least two equally spaced skewed nozzles cored through the nose of said teardrop to span said orifice as extended, said skew designed to induce a helical pattern in the primary flow for crypto-steady pressure exchange with the secondary stream.

4. Apparatus for jet pumping according to claim 1 wherein said means provides for the free rotation of said teardrop shaped body, said body provided with fan blades to produce said rotation.

5. Apparatus for jet pumping according to claims 1, 2, 3 or 4 wherein said means further constitutes a strut-supported stub shaft fitted over a central cavity in said teardrop-shaped body, said cavity being open at the down stream extremity of said teardrop-shaped to receive said shaft and serve as a bearing, being lubricated by fluid introduced through said strut and said shaft, said fluid provided with at least one exit toward the aft end of said teardrop-shaped body to be centrifugally flung at least as one additional secondary flow at this zone in the jet pump.

6. A jet pump turbo-compressor with concentric annular primary and secondary nozzles aligned to discharge into a mixed flow runner whereof the upstream or axial portion of the root contour for said mixed flow constitutes the rotating inner wall of said primary nozzle, its outer wall being fixed and serving to partition said nozzles, the blade paths of said runner conforming substantially to Archimedean Spirals, suitable vanes in said secondary annulus for directing flow into said paths, suitable shrouding for bounding said runner and collecting and discharging the outflow from said runner, a stub shaft supporting said runner mounted in and extending through a suitable housing, whereby orifices are provided in said root contour for admitting additional fluids, said orifices being manifolded to a continuous passage through the center of said stub shaft.

7. A turbo-jet pump and concentric annular primary and secondary nozzles, whereby the axial cross-section of said primary nozzles is formed by a substantially conical frustrum, as the common partition of said nozzles, and the root contour of a mixed flow runner, said axial cross-section conforming closely to the peripheral contour of said runner, said runner fairing-in in close proximity with a fixed continuing passage contoured to deflect the flow radially for ultimate centrifugal discharge, a stub shaft, supporting said runner, mounted centrally through said passage and supported further in a suitable external frame, whereby orifices are provided in said root contour for admitting additional fluids, said orifices being manifolded to a continuous passage through the center of said stub shaft.

8. The jet pump method for generating a fuel gas and the transport potential for said gas whereby the jet pump means comprises a confined space subjected to a substantially high fluid pressure developed by suitable fossil fuel fired means to deliver a jet capable of supplying most of the pre-reaction momentum required by the material delivered, into at least one secondary port of said jet pump means, at a relatively low velocity compared to that of said jet; a sequent zone of substantial length for the constituents of said jet to mix with and react with said material whereby the energy level after mixing, represented by the kinetic energy and flow energy of the flow in a conduit means down stream of said zone, is sufficiently high to first effect the separation of solid particles and to then effect a sequent separation of largely non-fuel fluids from said flow in cooperation with a cooling means to deliver a remanent flow comprising said fuel gas composed largely of carbon monoxide and hydrogen at a temperature substantially below the temperature of said flow at the point of said energy level and further whereby the reactant sources of said fuel gas are largely supplied as superheated water vapor, as a contituent of said jet, and carbon as a constituent of said material delivered into said secondary port and further whereby the heat of reaction for producing said carbon monoxide and said hydrogen is supplied largely by the heat content of the constituents of said jet, and said energy level is further established at least with respect to said cooling means to increase the total energy conversion efficiency in the yield of said fuel gas.

9. The jet pump method for generating a fuel gas with the transport potential for sequentially delivering said gas through, at the most, three efficiency-increasing operations, whereby the jet pump means comprises a confined space under a fluid pressure of at least 3 atmospheres for discharging a primary jet at a very high velocity at a temperature above 1400° F., of which a substantial portion is water vapor, at least one secondary port for the relatively very low velocity delivery of fluidized matter that is largely carbonaceous, a sequent zone for the mixing of said matter with the constituents of said jet which together contain combustion products where the combustion yielding said products was effected at least once in any part of said means, and further whereby other reactions taking place as a consequence of said mixing yield the constituents of said fuel gas which are largely carbon monoxide and hydrogen and further whereby the heat of reaction for producing said fuel gas is largely supplied by the heat content of said combustion products and whereby said fluid pressure is provided by a suitable fossil fuel-fired means so that most of the energy stored in said fossil fuel is converted into said fuel gas.

10. The method according to claim 8 or 9 whereby an oxygen bearing fluid and hydrogen are pumped into said space at said pressure and proportioned to substantially raise the temperature therein and to augment its water vapor content prior to delivering said jet.

11. The method according to claim 9 whereby said heat content is developed by delivering any hydrocarbon fuel and oxidant and water into said space at said pressure and fired to said temperature prior to delivering said jet.

12. The method according to claims 8, 9, or 11 whereby oxygen is introduced as a constituent of the flow into said secondary port to effect a combustion reaction on contact with said jet.

13. The method according to claim 8, 9, or 11 whereby hydrogen is introduced as a constituent of the flow into said secondary port to fire on contact at least partially with oxygen in the mixed flow.

14. The method according to claim 8 or 9 whereby the flow after said mixing continues in a suitable conduit to accommodate a boost in flow energy effected by proportioning the reactants for said combustion above that needed for said heat of reaction and said potential so as to develop a static pressure after said mixing of at least 2 atmospheres to drive a sequent jet through a suitable nozzle of a sequent jet pump means with at least one secondary port for introducing additional reactants to augment, on sequentially reacting, the fuel gas constituents in the flow.

15. The method according to claim 14 whereby said fluid pressure is effected by a turbine driven compressor whereby the fluid expanding through the turbine is heated water vapor which is exhausted and ducted into at least one secondary port of said sequent jet pump means to react largely on mixing with the carbon monoxide constituent of said sequent jet moving at a relatively much higher velocity than said water vapor to form carbondioxide and hydrogen.

16. The method according to claim 14 whereby steam is the principal reactant delivered into at least one secondary port of said sequent jet pump and proportioned to react largely with the carbon monoxide constituent of said sequent jet to form $CO_2$ and to yield hydrogen thereby augmenting the hydrogen content of said fuel gas.

17. The method according to claim 8 or 9 whereby additional oxidant is secondarily fed into said pump along with water-fluidized carbonaceous matter to fire spontaneously by being ignited on contact with the hot jet, said oxidant and water-fluidized carbonaceous matter being preproportioned to generate more water vapor to react sequentially with the carbon constituent in the mixed flow thereby largely yielding more carbon monoxide and more hydrogen along with $CO_2$ and ash.

18. The method according to claim 16 whereby most of the hydrogen is separated from other gases of considerably higher molecular weight by pressure diffusion, centrifugally, in a suitable separator by subjecting the continuous mixed stream to a substantially high velocity whereby the flow energy for transporting the mixture downstream through said separator is provided in the thrust potential of the combustion reactions taking place upstream.

19. The method according to claims 8 or 9 whereby the reaction for generating said fuel gas is set by the quenching effects of one or more of the following steps:

(a) preheating at least one oxidant, in an indirect heat transfer means, to be delivered under pressure to said jet pump means, (b) evaporating water, under pressure, by heat transfer to be delivered to said jet pump means, (c) exapanding the fuel gas in a turbo-compressor means for compressing at least one oxidant to be delivered to said jet pump means.

20. The method according to claim 8 or 9 whereby the velocities of said primary jet are up to critical supersonic conditions which effect shock waves and downstream sub-sonic flow, while said slow velocities for delivering secondary flows are over a fair range to effect adequate process control and conduit cleanliness but low enough to insure extremely large slip velocities between said jet and said secondary flows.

21. The method according to claim 20 whereby the flow downstream after mixing is caused to diverge in a diffuser means so that the gas-like constituents thereby decelerating at a faster rate than particulate matter develop a counter-slip with respect to said matter for enhancing heat and mass transfer and chemical reactivity.

22. The method according to claim 20 whereby said slip is developed with such high primary jet velocities to at least intensify the heat transfer rate to the point of fragmenting particulate matter from the relatively spontaneous expansion of the gases and vapors within the particles.

23. The jet pump method for generating a fuel gas and the transport potential for said gas whereby the jet pump means comprises a confined space under a substantially high fluid pressure for discharging a primary jet at a very high velocity and temperature, at least one secondary port for the delivery of fluidized, largely carbonaceous, matter at a very low velocity with respect to that of said jet, a sequent conduit zone for the mixing of said matter with the constituents of said jet which together contain combustion products whereby the combustion yielding said products takes place in said confined space to deliver said jet as a relatively inert high temperature fluid for the pyrolysis of said matter, thereby yielding components of said fuel gas in a mixed flow downstream of said pyrolysis and further whereby the energy level after said mixing represented by the kinetic energy and flow energy of the stream in a continuing conduit means is sufficiently high to first effect the separation of solid particles and then to effect the separation of largely non-fuel fluids from said flow in co-operation with a cooling means to deliver a remanent flow comprising largely the constituents of said fuel gas, and whereby said fluid pressure is provided by a suitable fossil-fuel-fired means so that most of the energy stored in said fossil fuel is converted to said fuel gas.

24. The method according to claim 23 whereby said combustion is in quasi stoichiometric proportion and its products are cooled on reacting to a controlled temperature by simultaneously delivering excess hydrogen whereby the resulting hydrogen-rich jet operates to largely hydrogenate said matter.

25. A jet pump apparatus with the capability of sustaining high fluid temperatures and pressures for generating a fuel gas and for transporting it through at least one sequent processing operation, said apparatus comprising a primary nozzle coupled to a pressure chamber constructed for well over two atmospheres and temperatures up to stoichiometric flame levels, at least one secondary supply housing fit with at least one supply port, the axis of said housing being concentric with said nozzle such that the inside diameter of the discharge annulus from said housing conforms in diameter, fairing in with and attaches to said nozzle at some distance aft of the discharge extremity of said nozzle, and the outside diameter of said discharge annulus conforms with and attaches to the aft extremity of a mixing duct of substantial length fairing into a continuous conduit, a quasi teardrop-shaped body located partially inside the downstream extremity of said nozzle to form a primary annular discharge orifice, the annular cross-sectional area conforming to the requirement of up-to-supersonic flow therethrough and whereby the discharge area of said orifice is varied for a range of flows by a suitable concentric support providing a fore-and-aft adjustment for said tear drop-shaped body and further, to preclude choking the downstream flow, the discharge area of said mixing duct is designed for sub-sonic flow and is determined with consistent units by dividing the total mixed volume flow rate by any value less than the theoretical sonic velocity for the composite gases flowing into said conduit.

26. Apparatus for jet pumping according to claim 25 wherein said suitable concentric support provides for the free rotation of said teardrop shaped body and the axial cross-section of said orifice is extended lengthwise and is reduced to mere clearance to redirect the primary flow through at least two equally spaced skewed nozzles cored through the nose of said teardrop to span said orifice as extended, said skew designed to induce a helical pattern in the primary flow for crypto-steady pressure exchange with the secondary stream.

27. Apparatus for jet pumping according to claim 26 wherein said suitable concentric support further constitutes a strut-supported stub shaft fitted over a central cavity in said teardrop shaped body, said cavity being open at the downstream extremity of said teardrop to receive said shaft and serve as a bearing, being lubricated by fluid introduced through said strut and said shaft, said fluid provided with at least one exit toward the aft end of said teardrop to be centrifugally flung, at least, as one additional secondary flow at this zone in the jet pump.

28. Apparatus for jet pumping according to claim 25 wherein said suitable concentric support provides for the free rotation of said teardrop shaped body here provided with fan blades to produce said rotation.

29. A jet pump turbo-compressor for converting jet thrust to rotary power comprising concentric primary and secondary nozzles aligned to discharge into a mixed-flow runner with a substantially long axial-turbine section for converting said thrust to said power, whereby the root contour of said section constitutes rotating channels and the extension of said primary nozzle, its outer wall being fixed and serves to partition said nozzles, the blade paths of said runner sequent to said section continuing to curve through 90° as viewed from side elevation, and conforming substantially to Archimedian Spirals, thereby forming the compressor-part of said runner designed for utilizing at least a portion of said power, suitable vanes in said secondary nozzle for directing flow into said paths, suitable shrouds for bounding said runner and collecting and discharging the outflow from said runner, a stub shaft supporting said runner mounted in a suitable housing.

30. A jet pump turbo-compressor as in claim 29 where in said stub shaft is extended through said housing for dividing and transmitting a portion of said power mechanically.

31. An apparatus of a plurality of jet pumps in series and operated in pressure cascade with the capability of sustaining high fluid temperatures and pressures in a first jet pump for generating a fuel gas and for transporting it through at least one sequent jet pump, said first jet pump comprising a first primary nozzle coupled to a pressure chamber constructed for over two atmospheres and over 1500° F., at least one secondary port supply housing, the axis of said housing being concentric with said nozzle such that the inside diameter of the discharge annulus from said housing conforms in diameter, fairing in with and attaches to said nozzle at some distance aft of the discharge extremity of said nozzle, and the outside diameter of said discharge annulus conforms with and attaches to the aft extremity of a mixing duct of substantial length, which also serves as the static-pressure accommodation section for powering said at least one segment jet pump in said series, said sequent jet pump comprising a sequent primary nozzle connected to and fairing in with aft extremity of said accommodation section with at least one secondary-port housing for receiving additional reactants for said fuel gas.

32. The series jet pump method for generating a fuel gas and the transport potential for said gas comprising the steps of:

delivering process reactants to at least one secondary part of said first jet pump;

firing a suitable fuel in the primary chamber of the first jet pump to develop a substantially high fluid pressure, discharging a jet from said chamber capable of supplying most of the pre-reaction mememtum for said process reactants as they are simultaneously delivered into said at least one secondary port of said first jet pump, mixing the substance of said jet and said reactants mix to form a reaction in a sequent zone designed for sub-sonic flow and a static pressure of at least two atmospheres, whereby said static pressure develops in a cascade from said high fluid pressure in cooperation with said reaction to power, at least, one sequent jet pump, delivering additional reactants into at least one secondary port of said sequent jet pump, and mixing said additional reactants with the flow from the jet of said sequent jet pump, in order to form a sequent reaction and to develop a static pressure, in cooperation with said cascade, which is sufficiently high to effect the separation of a substantial quantity of solid particles from the continuing flow downstream by inertial means to yield said fuel gas.

33. The method according to claim 32 whereby the constituents of combustion in said primary chamber, of said process reactants and of said additional reactants are proportioned for reacting to yield products containing substantial quantities of hydrogen and carbon dioxide and whereby the flow of said fuel gas after said separation sustains a sufficiently high static pressure level to effect the sequent separation of a substantial amount of hydrogen from other gases of considerably high molecular weight by pressure diffusion in a suitable separator by subjecting the continuous mixed stream to a very high velocity.

34. The method according to claim 32 whereby the constituents of combustion in said primary chamber, of said process reactants and of said additional reactants are proportioned for reacting to yield products containing substantial quantities of hydrogen and carbon dioxide and whereby the flow of said fuel gas after said separation sustains a sufficiently high static pressure level to effect the sequent separation of a substantial amount of hydrogen from other gases of considerably higher molecular weight by a separator means wherein a pressure gradient is established by a centrifugal field in the flow and whereby the separation effect is enhanced by a thermal gradient superimposed across said field by suitable means.

* * * * *